US010600299B2

(12) United States Patent
Faubion et al.

(10) Patent No.: US 10,600,299 B2
(45) Date of Patent: Mar. 24, 2020

(54) SMOKE DETECTOR WITH REMOVABLE BATTERY COMPARTMENT

(71) Applicants: Steven Benjamin Faubion, Ellensburg, WA (US); Peggy Ann Faubion, Ellensburg, WA (US)

(72) Inventors: Steven Benjamin Faubion, Ellensburg, WA (US); Peggy Ann Faubion, Ellensburg, WA (US)

( * ) Notice: Subject to any disclaimer, the term of this patent is extended or adjusted under 35 U.S.C. 154(b) by 0 days.

(21) Appl. No.: 15/096,071

(22) Filed: Apr. 11, 2016

(65) Prior Publication Data

US 2017/0109986 A1 Apr. 20, 2017

Related U.S. Application Data

(60) Provisional application No. 62/241,930, filed on Oct. 15, 2015.

(51) Int. Cl.

| | |
|---|---|
| ***G08B 17/00*** | (2006.01) |
| ***G08B 17/113*** | (2006.01) |
| ***G08B 29/18*** | (2006.01) |

(52) U.S. Cl.

CPC ..... *G08B 17/00* (2013.01); *G08B 17/113* (2013.01); *G08B 29/181* (2013.01)

(58) Field of Classification Search

None

See application file for complete search history.

(56) References Cited

U.S. PATENT DOCUMENTS

| | | | | | |
|---|---|---|---|---|---|
| 4,090,178 | A * | 5/1978 | Norris | F21V 33/0076 | 340/506 |
| 4,315,594 | A * | 2/1982 | Niederost | G08B 17/113 | 340/693.11 |
| 4,694,285 | A * | 9/1987 | Scripps | F21V 33/0076 | 340/586 |
| 4,980,672 | A * | 12/1990 | Murphy | G08B 13/1409 | 315/136 |
| 5,280,273 | A * | 1/1994 | Goldstein | G01N 33/004 | 340/628 |
| 5,281,954 | A * | 1/1994 | Harrison | H01M 2/1022 | 340/628 |
| 5,596,314 | A * | 1/1997 | Goldstein | G08B 17/103 | 340/628 |
| 5,617,079 | A * | 4/1997 | Harrison | G08B 17/00 | 340/628 |
| 5,731,759 | A * | 3/1998 | Finucan | F21L 4/005 | 340/574 |
| 5,765,453 | A * | 6/1998 | Mims | F21V 19/04 | 294/210 |
| 6,117,030 | A * | 9/2000 | Green, Sr. | A63B 43/06 | 473/570 |

(Continued)

*Primary Examiner* — Curtis J King

(74) *Attorney, Agent, or Firm* — Christopher Mayle; John Houvener; Bold IP, PLLC

(57) ABSTRACT

A removable battery compartment for use with a smoke detector having a first connector portion configured to receive power from a battery. The battery compartment includes an interior chamber configured to house the battery and a second connector portion configured to be removably coupled to the first connector portion. The second connector portion has electrical connections configured to supply power from the battery to the first connector portion of the smoke detector.

5 Claims, 25 Drawing Sheets

(56) References Cited

U.S. PATENT DOCUMENTS 6,402,342 B1 * 6/2002 Chiang ..... A63H 33/18 362/184
6,730,432 B1 * 5/2004 Grosfeld ..... H01M 2/1066 206/703
6,953,260 B1 * 10/2005 Allen ..... F21L 4/027 362/194
7,255,024 B2 * 8/2007 Johnson ..... H01J 9/003 81/53.1
7,388,350 B1 * 6/2008 Wright ..... G08C 17/02 320/107
7,414,538 B2 * 8/2008 Cook ..... G08B 17/10 340/628
7,971,844 B2 * 7/2011 Newport ..... G01D 11/245 248/320
8,371,547 B2 * 2/2013 Wilkowske ..... G01D 11/245 248/310
8,910,820 B2 * 12/2014 Sharpe ..... G08B 17/10 220/481
9,133,994 B2 * 9/2015 Dowdy ..... F21S 8/04
2002/0154018 A1 * 10/2002 Nishikawa ..... G08B 17/107 340/630
2002/0170142 A1 * 11/2002 Kelly ..... G08B 29/145 16/110.1
2003/0029279 A1 * 2/2003 Wantz ..... B25B 9/00 81/53.1
2003/0227389 A1 * 12/2003 McGreal ..... G08B 17/10 340/628
2006/0152376 A1 * 7/2006 Demster ..... G08B 17/10 340/636.1
2006/0162502 A1 * 7/2006 Huang ..... B25B 9/00 81/53.12
2006/0171145 A1 * 8/2006 Ford ..... F21L 4/027 362/200
2007/0103330 A1 * 5/2007 McGrath ..... G08B 17/10 340/693.1
2007/0285262 A1 * 12/2007 Lax ..... G08B 17/113 340/628
2008/0246618 A1 * 10/2008 Siber ..... G08B 17/10 340/577
2009/0237260 A1 * 9/2009 Bradley, Jr. ..... G08B 17/113 340/628
2011/0084844 A1 * 4/2011 Carnation ..... G08B 17/10 340/628
2011/0245866 A1 * 10/2011 Cassingham .... A61B 17/00491 606/213
2012/0263979 A1 * 10/2012 Jensen ..... H01M 2/105 429/50
2014/0007678 A1 * 1/2014 Lehti ..... G08B 17/10 73/431
2016/0323118 A1 * 11/2016 DiPoala ..... H04L 12/2827
2016/0372939 A1 * 12/2016 Roehm ..... B25F 5/00

* cited by examiner

SMOKE DETECTOR WITH REMOVABLE BATTERY COMPARTMENT

CROSS REFERENCE TO RELATED APPLICATION(S)

This application claims the benefit of U.S. Provisional Application No. 62/241,930, filed on Oct. 15, 2015, which is incorporated herein by reference in its entirety.

BACKGROUND OF THE INVENTION

Field of the Invention

The present invention is directed generally to smoke detectors.

Description of the Related Art

Conventional smoke detectors include a battery as either a backup power source or a primary power source. Unfortunately, when that battery begins to lose its charge, the smoke detector produces an audible low-battery sound indicator (e.g., one or more chirps) indicating the battery needs replacement. This sound can be very upsetting to homeowners who are not expecting it. Further, because smoke detectors are typically installed on ceilings or on walls near the ceiling, a ladder is often needed to replace the battery. Therefore, a need exists for methods and systems that avoid the use of a ladder to change the battery. The present application provides these and other advantages as will be apparent from the following detailed description and accompanying figures.

BRIEF DESCRIPTION OF THE SEVERAL VIEWS OF THE DRAWING(S)

Like reference numerals have been used to identify like components in the figures.

DETAILED DESCRIPTION OF THE INVENTION

Figure 1:
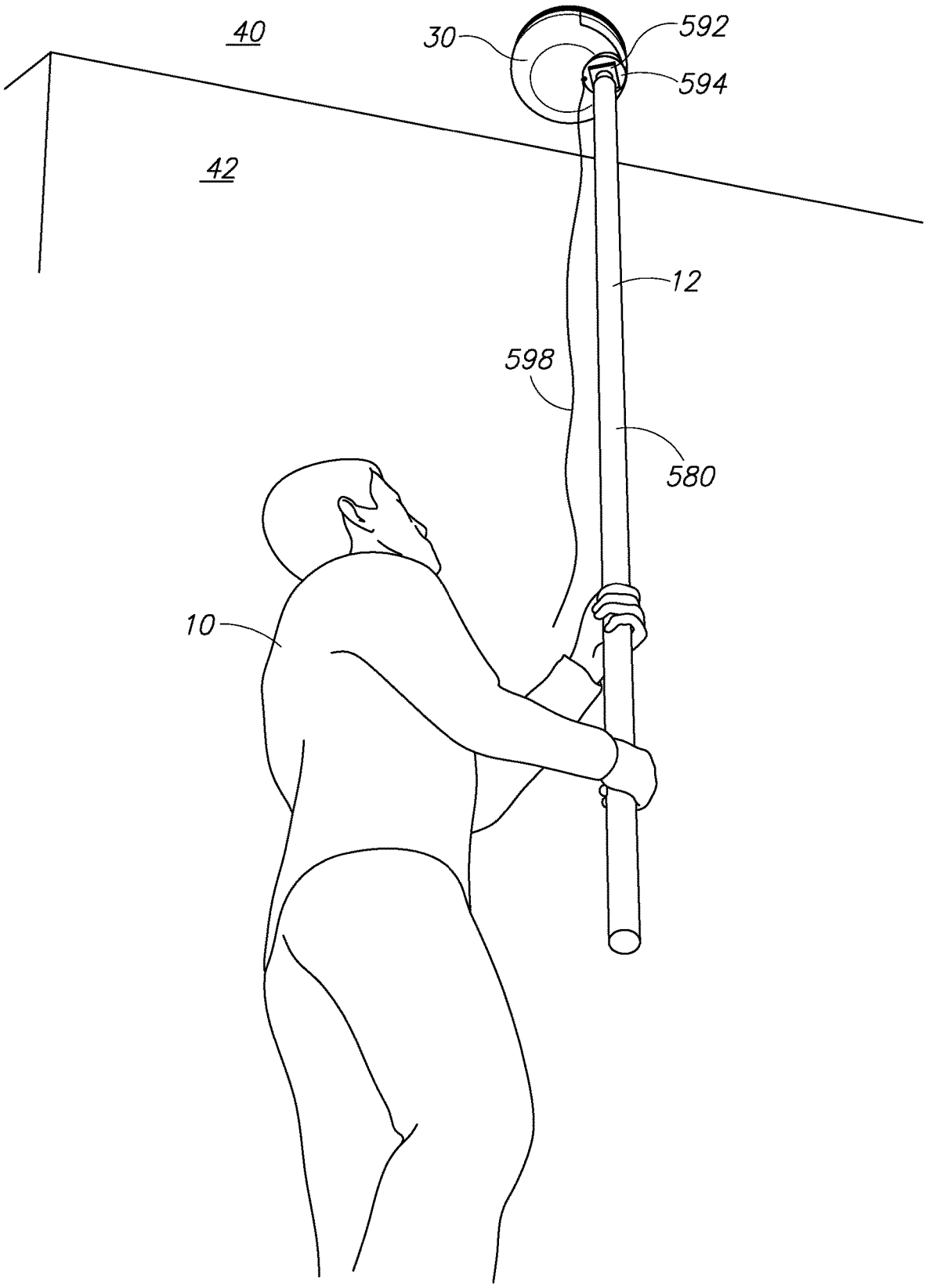
FIG. 1 is a perspective view of a user using a tool to remove a removable battery compartment from a first embodiment of a smoke detector.

FIG. 1 is a perspective view of a user 10 using a tool 12 to remove a removable battery compartment 20 (see FIGS. 2A-3) from a first embodiment of a smoke detector 30 mounted on a ceiling 40 adjacent to a wall 42. While the smoke detector 30 has been depicted as being mounted on the ceiling 40, the smoke detector 30 may alternatively be mounted on a different structure (e.g., on the wall 42 near the ceiling 40).

Figure 2A:
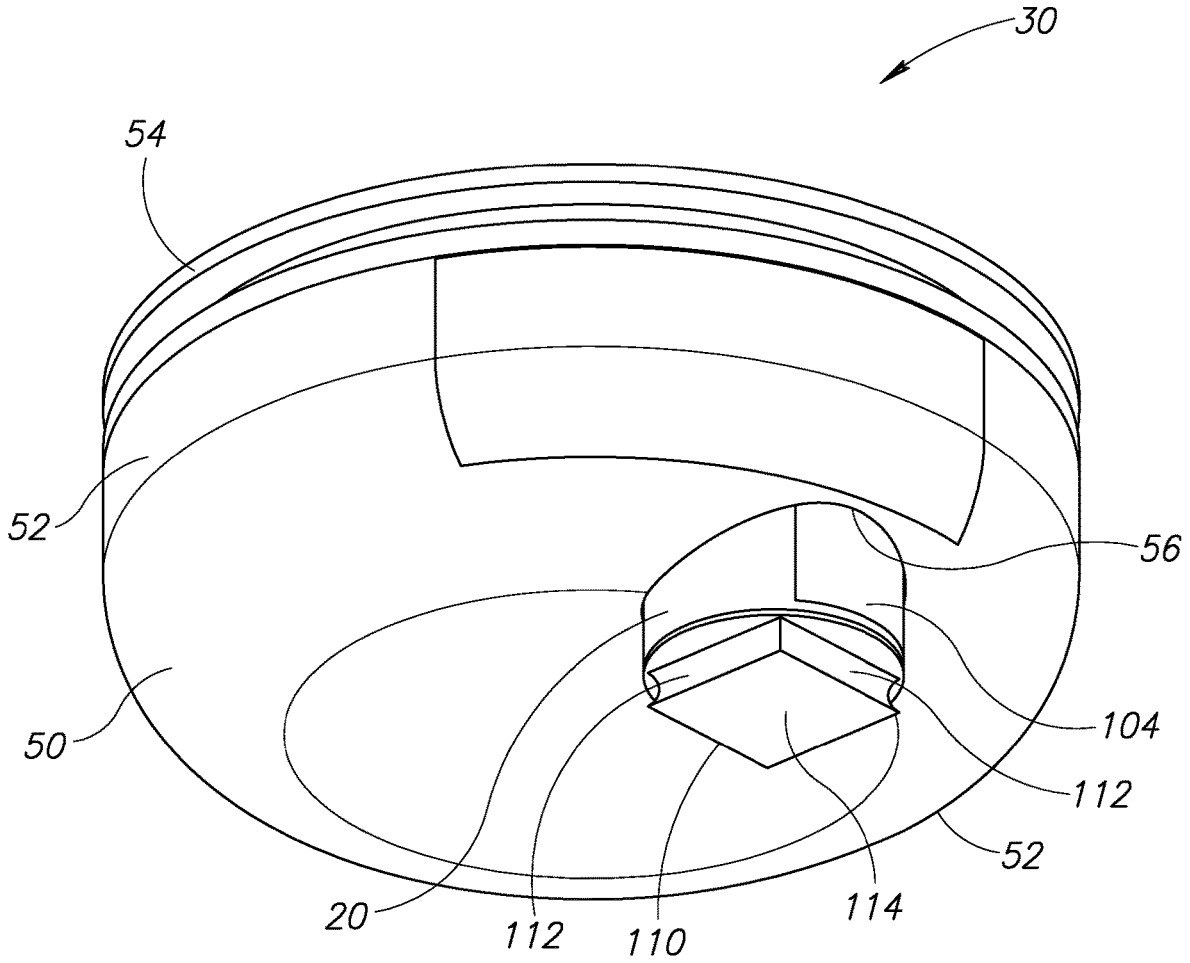
FIG. 2A is a perspective view of the smoke detector of FIG. 1.

Referring to FIG. 2A, the smoke detector 30 includes the battery compartment 20 and a housing body 50. The battery compartment 20 is configured to be selectively coupled to and decoupled from the housing body 50 (e.g., using the tool 12 illustrated in FIG. 1).

Figure 2B:
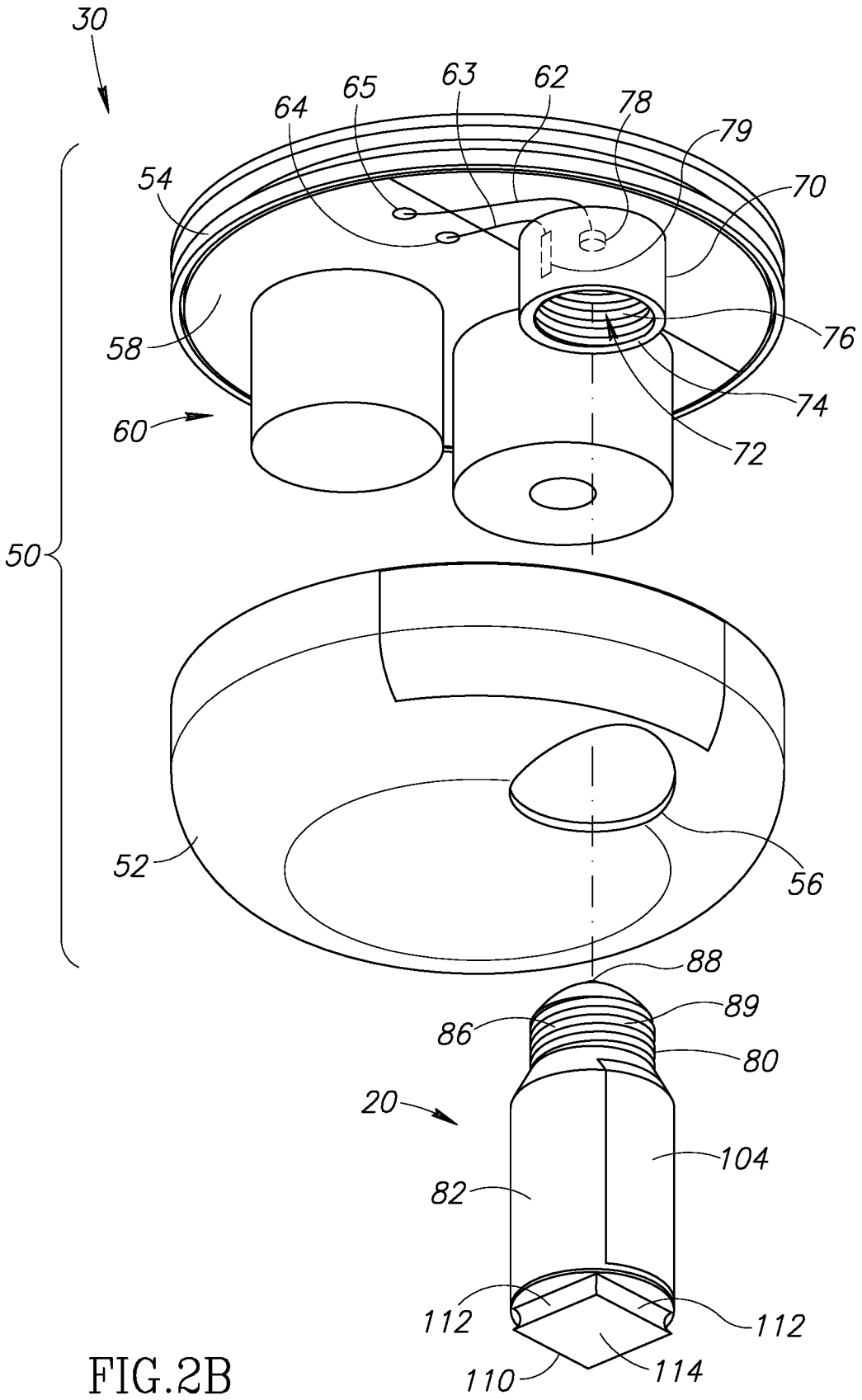
FIG. 2B is a partially exploded perspective view of the smoke detector of FIG. 1.

Referring to FIG. 2B, the housing body 50 includes a housing cover 52 and a housing base 54. The housing cover 52 may be removably coupled to the housing base 54. A through-hole 56 is formed in the housing cover 52. The through-hole 56 is configured to allow the battery compartment 20 to pass therethrough unobstructed.

The housing base 54 is mountable to a surface (e.g., the ceiling 40 or the wall 42 illustrated in FIG. 1). One or more components of a smoke detector system 60 are housed inside the housing body 50 and may be coupled to the housing base 54. The smoke detector system 60 is configured to detect smoke and sound an alarm when smoke is detected. The smoke detector system 60 may be implemented using standard electrical components conventionally used to implement smoke alarm systems. In the embodiment illustrated, at least a portion of the smoke detector system 60 is mounted on a substrate 58 (e.g., a printed circuit board) attached to the housing base 54. The substrate 58 includes electrical contacts 64 and 65 and conductors (not shown) that conduct power from the electrical contacts 64 and 65 to at least some of the components of the smoke detector system 60. The smoke detector system 60 may be configured to produces an audible low-battery sound indicator (e.g., one or more chirps) when the smoke detector system 60 receives below a threshold amount of power from the electrical contacts 64 and 65 (which receive power from a battery 94 illustrated in FIG. 3).

The housing base 54 has a threaded connector portion 70 that is substantially similar to a standard light bulb socket. The threaded connector portion 70 includes an outwardly opening cavity 72 defined in part by a cylindrically shaped sidewall 74 with inside threads 76 formed therein. Electrical connections 78 and 79 are positioned inside the cavity 72. Electrical connections 62 and 63 (e.g., wires) physically contact and form electrical connections between with the electrical connections 78 and 79, respectively, and the electrical contacts 64 and 65, respectively. The conductors (not shown) on the substrate 58 that conduct power to at least some of the components of the smoke detector system 60 receive power from the electrical contacts 64 and 65, which receive power from the electrical connections 62 and 63, respectively. The electrical connections 62 and 63 receive power from the electrical connections 78 and 79, respectively. Thus, power may be transmitted from the electrical connections 78 and 79 to the electrical contacts 64 and 65, respectively, and onward to at least some of the components of the smoke detector system 60.

Figure 3:
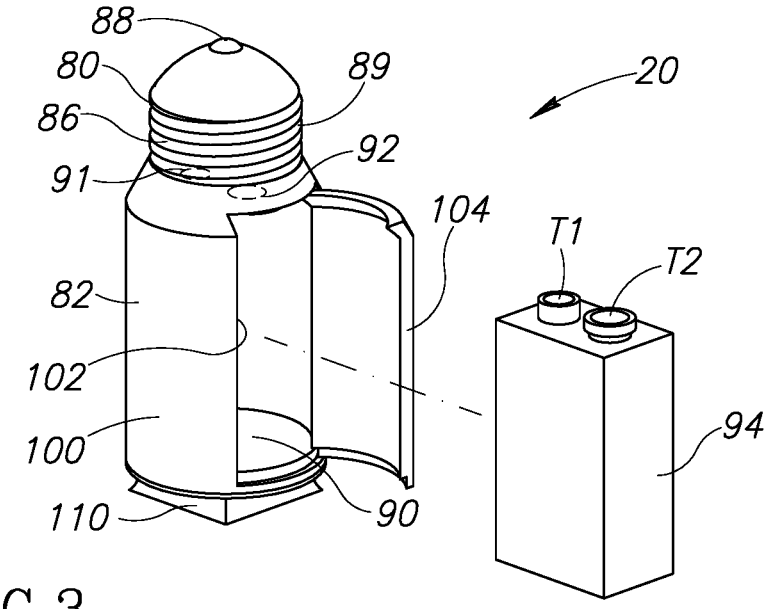
FIG. 3 is a perspective view of a first embodiment of the removable battery compartment for use with the smoke detector of FIG. 1.

Referring to FIG. 3, the battery compartment 20 has a threaded connector portion 80 and a battery compartment portion 82. The threaded connector portion 80 is substantially similar to a threaded portion or base of a standard light bulb (e.g., a standard base, an appliance size base, a smaller base, and the like). The threaded connector portion 80 has outside threads 86 configured to mate with the inside threads 76 (see FIG. 2B) of the threaded connector portion 70 (see FIG. 2B). Thus, referring to FIG. 2B, the threaded connector portion 80 is configured to be threadedly engaged with the threaded connector portion 70.

Electrical connections 88 and 89 are positioned on the threaded connector portion 80. The electrical connections 88 and 89 physically contact and form electrical connections with the electrical connections 78 and 79, respectively, when the threaded connector portion 80 is fully threaded to the threaded connector portion 70. The electrical connections 88 and 89 are substantially similar to electrical connections of a standard light bulb, and the electrical connections 78 and 79 are substantially similar to electrical connections of a standard light bulb socket. Thus, the electrical connection 89 may include or be formed by the outside threads 86, and the electrical connection 79 may include or be formed by the inside threads 76.

Referring to FIG. 3, the battery compartment portion 82 includes an interior chamber 90 configured to house the battery 94 (e.g., a 9 Volt battery). The battery compartment portion 82 includes electrical connections 91 and 92 positioned to physically contact and form electrical connections with battery terminals T1 and T2, respectively, of the battery 94. The electrical connections 91 and 92 electrically interconnect the battery terminals T1 and T2, respectively, with the electrical connections 88 and 89, respectively.

Referring to FIG. 2B, when the threaded connector portion 80 is threaded into the outwardly opening cavity 72 of the threaded connector portion 70, the electrical connections 88 and 89 physically contact and form electrical connections with the electrical connections 78 and 79, respectively. As explained above, the electrical connections 88 and 89 receive power (via the electrical connections 91 and 92, respectively, illustrated in FIG. 3) from the battery terminals T1 and T2 (see FIG. 3), respectively. Referring to FIG. 2B, the electrical connections 88 and 89 transmit this power to the electrical connections 78 and 79, respectively, which (as explained above) in turn, transmit the power to at least some of the components of the smoke detector system 60 (via the electrical connections 62 and 63, respectively, and the electrical contacts 64 and 65, respectively). As mentioned above, the smoke detector system 60 may be configured to produces the audible low-battery sound indicator (e.g., one or more chirps) when the smoke detector system 60 receives less than the threshold amount of power from the electrical contacts 64 and 65. Thus, the smoke detector system 60 may be configured to produces the audible low-battery sound indicator to indicate the battery 94 has been depleted and needs replacement.

Referring to FIG. 3, the interior chamber 90 is defined by a sidewall 100 with an opening 102 formed therein. The opening 102 is configured to allow the battery 94 to pass therethrough unobstructed into and out of the interior chamber 90. A door 104 is hingedly coupled to the sidewall 100 along an edge of the opening 102. The door 104 is configured to be selectively rotated between an open position (see FIG. 3) and a closed position (see FIG. 2B). The door 104 may be opened after the battery compartment 20 has been uncoupled from the threaded connector portion 70 (see FIG. 2B) of the housing body 50 (see FIGS. 1-2B) to position the battery 94 inside the interior chamber 90. The door 104 may be closed to couple the battery compartment 20 to the threaded connector portion 70 (see FIG. 2B) after the battery 94 has been positioned inside the interior chamber 90 (e.g., after the battery 94 has been replaced).

Referring to FIG. 2B, the battery compartment portion 82 may include an external gripping portion 110 configured to be gripped by the tool 12 (see FIG. 1). In the embodiment illustrated, the gripping portion 110 is positioned below the interior chamber 90 (see FIG. 3) and has a generally square cross-sectional shape defined by a plurality of concave sidewalls 112 that terminate at an outwardly facing end surface 114. By way of non-limiting examples, the end surface 114 may be generally square (e.g., about 0.75 inches by about 0.75 inches) and the sidewalls 112 may each be about 0.5 inches tall.

Figure 4:
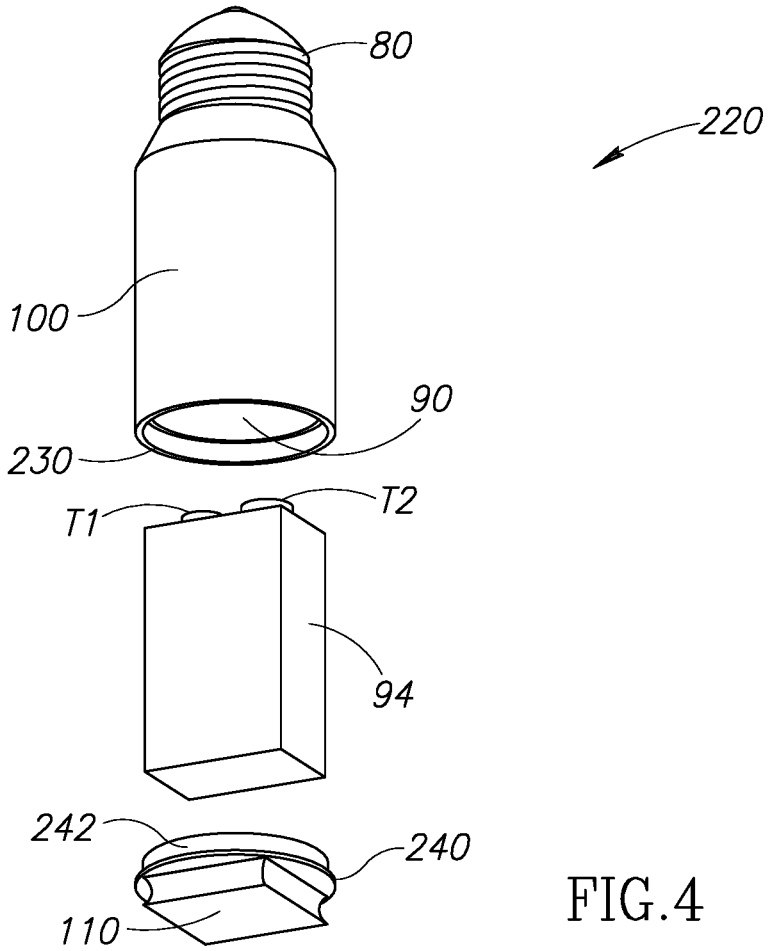
FIG. 4 is a perspective view of a second embodiment of a removable battery compartment for use with the smoke detector of FIG. 1.

FIG. 4 is a perspective view of a second embodiment of a removable battery compartment 220 that may be used with the housing body 50 (see FIGS. 2A and 2B). The battery compartment 220 is substantially similar to the battery compartment 20 (see FIGS. 2A-3) and like reference numerals have been used to identify like components in FIGS. 1-4.

Therefore, only differences between the battery compartment 220 and the battery compartment 20 (see FIGS. 2A-3) will be described in detail.

Referring to FIG. 4, the battery compartment 220 omits the door 104 (see FIGS. 2A-3) and the opening 102 (see FIG. 2B) formed in the sidewall 100. Instead, the interior chamber 90 has an open end 230. In the embodiment illustrated, the open end 230 is opposite the threaded connector portion 80. The open end 230 is configured to allow the battery 94 to pass therethrough unobstructed into and out of the interior chamber 90. Inside threads (not shown) may be formed in the sidewall 100 along the open end 230. The battery compartment 220 includes a removable cap 240 configured to be received within and close the open end 230 of the interior chamber 90. The cap 240 traps the battery 94 inside the interior chamber 90 and may push the battery terminals T1 and T2 into engagement with the electrical connections 91 and 92 (see FIG. 3), respectively. Optionally, outside threads (not shown) may be formed on a peripheral edge 242 of the cap 240. The outside threads (not shown) may be configured to mate with the inside threads (not shown) formed in the sidewall 100 along the open end 230. In this embodiment, the gripping portion 110 is formed in the cap 240 and extends outwardly therefrom.

In the embodiment illustrated, the open end 230 is opposite the threaded connector portion 80. However, in alternate embodiments, the open end 230 may be formed under the threaded connector portion 80. In such embodiments, the cap 240 includes the threaded connector portion 80 and the gripping portion 110 is positioned below the interior chamber 90 (see FIG. 3) as in the battery compartment 20 (see FIGS. 2A-3).

Because the battery compartment 20 (see FIGS. 2A-3) and the battery compartment 220 are each configured to be removed using the tool 12 (see FIG. 1), both of these compartments allows the battery 94 to be replaced without the use of a ladder.

Figure 5A:
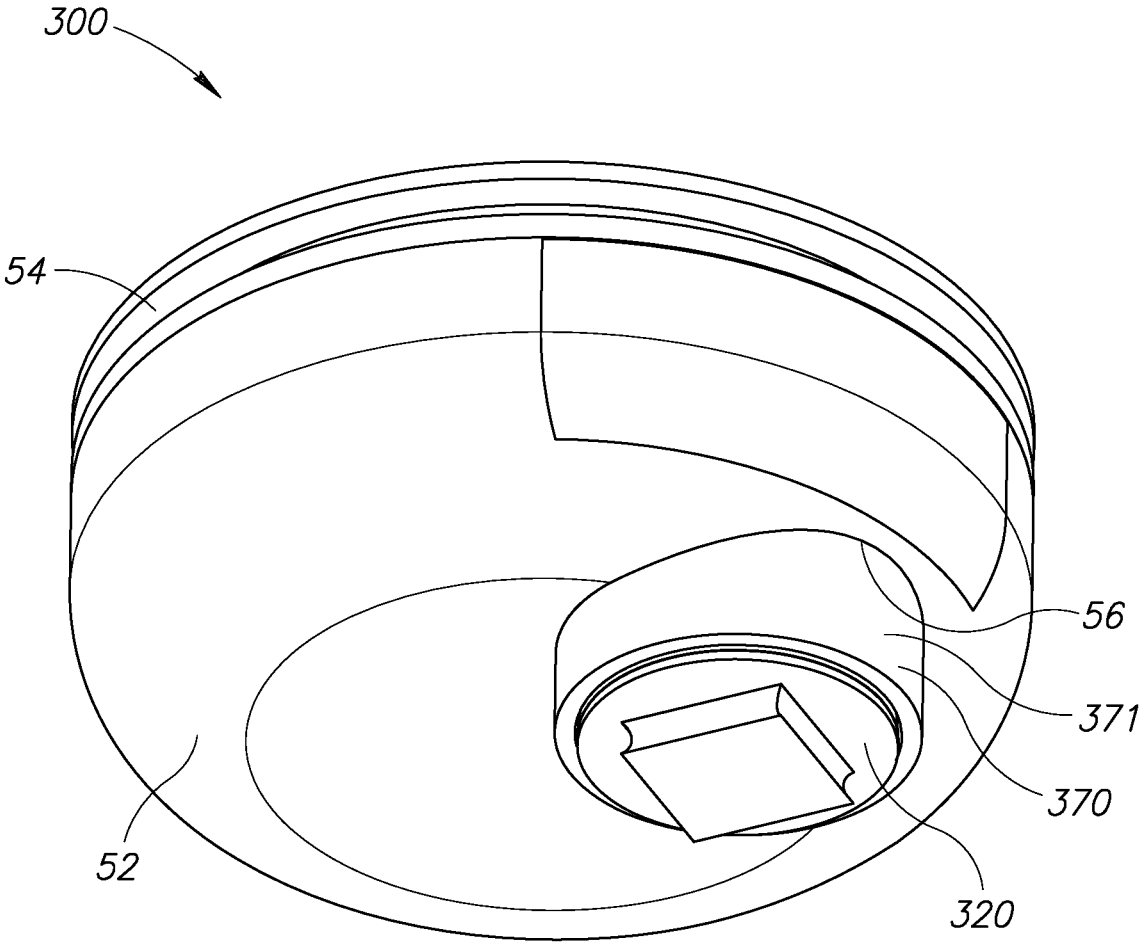
FIG. 5A is a perspective view of a second embodiment of a smoke detector.
Figure 5B:
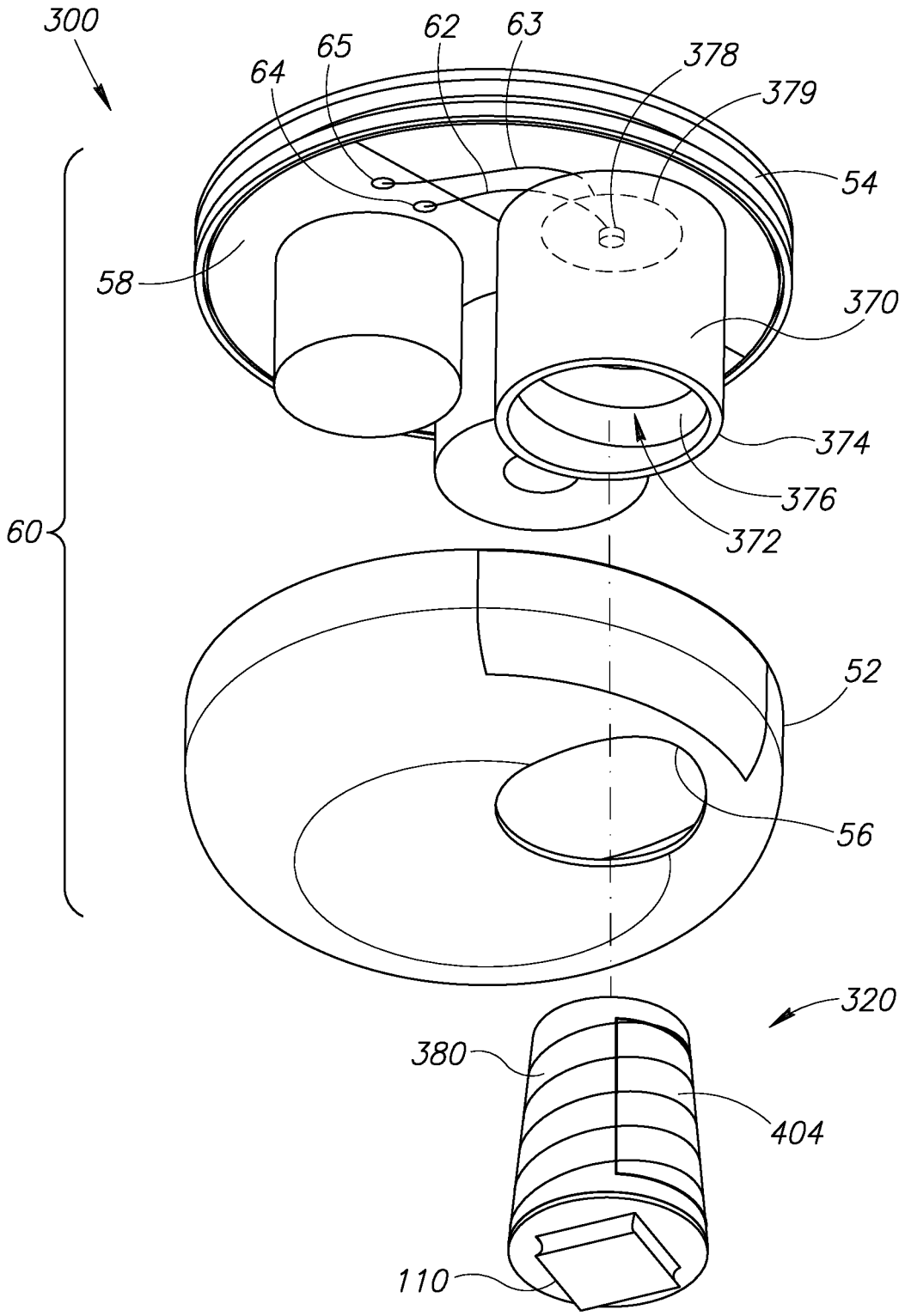
FIG. 5B is a partially exploded perspective view of the smoke detector of FIG. 5A.

FIG. 5A is a perspective view of a second embodiment of a smoke detector 300 and FIG. 5B is a partially exploded perspective view of the smoke detector 300. The smoke detector 300 is substantially similar to the smoke detector 30 (see FIGS. 1-2B) and like reference numerals have been used to identify like components in FIGS. 2A, 2B, 3, and 5A-6. Therefore, only differences between the smoke detector 300 and the smoke detector 30 (see FIGS. 1-2B) will be described in detail.

Referring to FIG. 5B, the smoke detector 300 omits the battery compartment 20 (see FIGS. 2A-3) and the threaded connector portion 70 (see FIG. 2B). Instead, the smoke detector 300 includes a removable battery compartment 320 and a threaded connector portion 370.

The threaded connector portion 370 includes an outwardly opening cavity 372 defined at least in part by a cylindrically shaped sidewall 374 with inside threads 376 formed therein. Referring to FIG. 5A, in this embodiment, the through-hole 56 formed in the housing cover 52 is configured to allow a distal portion 371 of the cylindrically shaped sidewall 374 to pass therethrough. Referring to FIG. 5B, electrical connections 378 and 379 are positioned inside the cavity 372. The electrical connection 379 is generally circular in shape and the electrical connection 378 is positioned at or near the center of a circle defined by the electrical connection 379. The electrical connections 62 and 63 (e.g., wires) physically contact and form electrical connections with the electrical connections 378 and 379, respectively. As mentioned above, the electrical connections 62 and 63 physically contact and form electrical connections with the electrical contacts 64 and 65, respectively, on the substrate 58. Thus, power may be transmitted from the electrical connections 378 and 379 (via the electrical connections 62 and 63, respectively) to the electrical contacts 64 and 65, respectively, and onward to at least some of the components of the smoke detector system 60.

Figure 6:
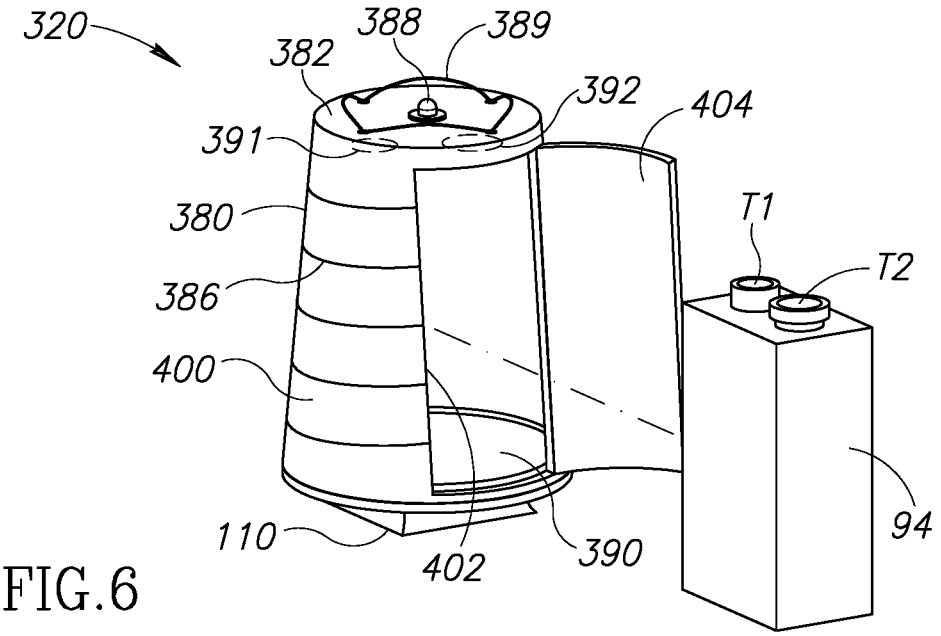
FIG. 6 is a perspective view of a first embodiment of a removable battery compartment for use with the smoke detector of FIG. 5A.

Referring to FIG. 6, the battery compartment 320 has a threaded battery compartment portion 380 with outside threads 386 configured to mate with the inside threads 376 (see FIG. 5B) of the threaded connector portion 370 (see FIG. 5B). Thus, referring to FIG. 5B, the threaded battery compartment portion 380 is configured to be threadedly engaged with the threaded connector portion 370. The threaded battery compartment portion 380 may include the gripping portion 110 configured to be gripped by the tool 12 (see FIG. 1). Thus, the tool 12 (see FIG. 1) may be used to thread the threaded battery compartment portion 380 into and out of the threaded connector portion 370.

Referring to FIG. 6, electrical connections 388 and 389 are positioned on a proximal end 382 of the threaded battery compartment portion 380. The electrical connections 388 and 389 physically contact and form electrical connections with the electrical connections 378 and 379 (see FIG. 5B), respectively, when the threaded battery compartment portion 380 is fully threaded to the threaded connector portion 370. The electrical connection 389 is generally circular in shape and the electrical connection 388 is positioned at or near the center of a circle defined by the electrical connection 389. In the embodiment illustrated, the electrical connection 388 is implemented as a conductive pin (biased outwardly by a spring) configured to retract slightly when the electrical connection 388 engages the electrical connection 378, and the electrical connection 389 is implemented as conductive (e.g., a metal) flexible ring with loops formed therein. The loops are configured to flex or contract slightly when the electrical connection 389 engages the electrical connection 379. In other words, the electrical connection 388 may be a spring pin and the electrical connection 389 may be an outer circular metal spring strip. Such embodiments may be characterized as having a spring loaded and/or twist and lock cog connection. The electrical connections 388 and 389 are configured to accommodate slight variations in height of the electrical connections 378 and 379, respectively.

Referring to FIG. 6, the threaded battery compartment portion 380 includes an interior chamber 390 substantially identical to the interior chamber 90 (see FIGS. 3 and 4) and configured to house the battery 94. In the embodiment illustrated, the gripping portion 110 is positioned below the interior chamber 390. The threaded battery compartment portion 380 includes electrical connections 391 and 392 positioned to physically contact and form electrical connections with the battery terminals T1 and T2, respectively, of the battery 94. The electrical connections 391 and 392 electrically interconnect the battery terminals T1 and T2, respectively, with the electrical connections 388 and 389, respectively.

Referring to FIG. 5B, when the threaded battery compartment portion 380 is threaded into the outwardly opening cavity 372 of the threaded connector portion 370, the electrical connections 388 and 389 physically contact and form electrical connections with the electrical connections 378 and 379, respectively. As explained above, the electrical connections 388 and 389 receive power (via the electrical connections 391 and 392, respectively, illustrated in FIG. 6) from the battery terminals T1 and T2 (see FIG. 3), respectively. Referring to FIG. 5B, the electrical connections 388 and 389 transmit this power to the electrical connections 378 and 379, respectively, which (as explained above) in turn, transmit the power to at least some of the components of the smoke detector system 60 (via the electrical connections 62 and 63, respectively, and the electrical contacts 64 and 65, respectively).

Referring to FIG. 6, the interior chamber 390 is defined by a sidewall 400 with an opening 402 formed therein. The opening 402 is configured to allow the battery 94 to pass therethrough unobstructed into and out of the interior chamber 390. A door 404 is hingedly coupled to the sidewall 400 along an edge of the opening 402. The door 404 is configured to be selectively rotated between an open position (see FIG. 6) and a closed position (see FIG. 5B). The door 404 may be opened after the battery compartment 320 has been uncoupled from the threaded connector portion 370 (see FIG. 5B) to position the battery 94 inside the interior chamber 390. The door 404 may be closed to couple the battery compartment 320 to the threaded connector portion 370 (see FIG. 5B) after the battery 94 has been positioned inside the interior chamber 390 (e.g., after the battery 94 has been replaced).

Figure 7:
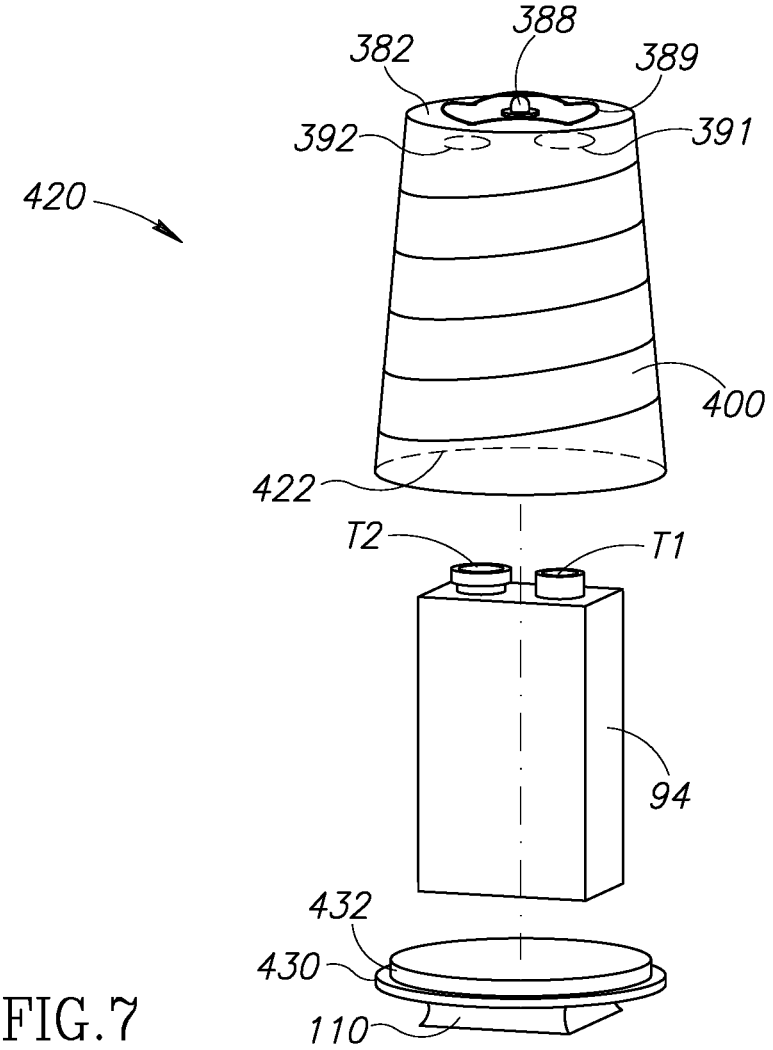
FIG. 7 is a perspective view of a second embodiment of a removable battery compartment for use with the smoke detector of FIG. 5A.

FIG. 7 is a perspective view of a second embodiment of a removable battery compartment 420 that may be used with the threaded connector portion 370 (see FIGS. 5A and 5B). The battery compartment 420 is substantially similar to the battery compartment 320 (see FIGS. 5A-6) and like reference numerals have been used to identify like components in FIGS. 6 and 7. Therefore, only differences between the battery compartment 420 and the battery compartment 320 (see FIGS. 5A-6) will be described in detail.

Referring to FIG. 7, the battery compartment 420 omits the door 404 (see FIGS. 5B and 6) and the opening 402 (see FIG. 6) formed in the sidewall 400. Instead, the interior chamber 390 has an open end 422. In the embodiment illustrated, the open end 422 is opposite the proximal end 382. The open end 422 is configured to allow the battery 94 to pass therethrough unobstructed into and out of the interior chamber 390 (see FIG. 6). Inside threads (not shown) may be formed in the sidewall 400 along the open end 422. The battery compartment 420 includes a removable cap 430 configured to be received within and close the open end 422 of the interior chamber 390 (see FIG. 6). The cap 430 traps the battery 94 inside the interior chamber 390 (see FIG. 6) and may push the battery terminals T1 and T2 into engagement with the electrical connections 391 and 392, respectively. Optionally, outside threads (not shown) may be formed on a peripheral edge 432 of the cap 430. The outside threads (not shown) may be configured to mate with the inside threads (not shown) formed in the sidewall 400 along the open end 422. In this embodiment, the gripping portion 110 is formed in the cap 430 and extends outwardly therefrom.

In the embodiment illustrated, the open end 422 is opposite the proximal end 382. However, in alternate embodiments, the open end 422 may be formed below the proximal end 382. In such embodiments, the cap 430 includes the proximal end 382 and the electrical connections 388 and 389. Further, the gripping portion 110 may be positioned below the interior chamber 390 (see FIG. 6) as in the battery compartment 320 (see FIGS. 5A-6).

Because the battery compartment 320 (see FIGS. 2A-3) and the battery compartment 420 are each configured to be removed using the tool 12 (see FIG. 1), both of these compartments allows the battery 94 to be replaced without the use of a ladder.

Figure 8:
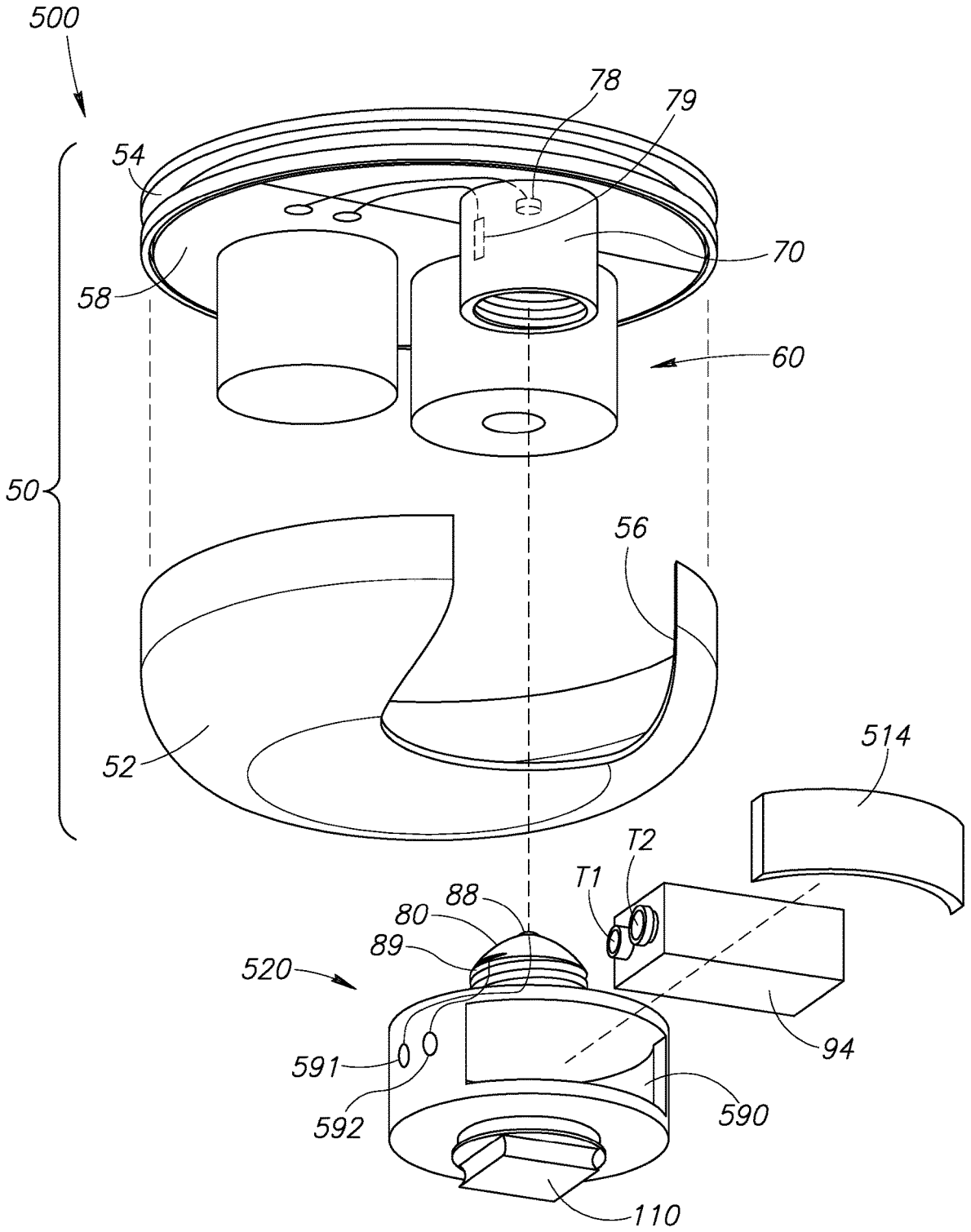
FIG. 8 is a partially exploded perspective view of a third embodiment of a smoke detector.

FIG. 8 is a perspective view of a third embodiment of a smoke detector 500. The smoke detector 500 is substantially similar to the smoke detector 30 (see FIGS. 1-2B) and like reference numerals have been used to identify like components in FIGS. 2A, 2B, 3, and 8. However, the smoke detector 500 differs from the smoke detector 30 in two respects. First, the smoke detector 500 includes a removable battery compartment 520 configured to be threadedly engaged with the housing body 50 along its periphery. Thus, as shown in FIG. 8, the through-hole 56 may be formed along the periphery of the housing cover 52. Second, the battery 94 is positioned horizontally inside the battery compartment 520. Nevertheless, like the battery compartment 20 (see FIGS. 2A-3), the battery compartment 520 may be removed from the housing body 50 by the tool 12 (see FIG. 1) because the battery compartment 520 includes the gripping portion 110.

The battery compartment 520 includes the threaded connector portion 80 with the electrical connections 88 and 89. The battery compartment 520 also includes an interior chamber 590 configured to house the battery 94. Inside the interior chamber 590, the battery compartment 520 has electrical connections 591 and 592 configured to physically contact and form electrical connections with the battery terminals T1 and T2, respectively. The electrical connections 591 and 592 are electrically connected to the electrical connections 88 and 89, respectively. The battery compartment 520 may include a cover or door 514 substantially similar to the door 104 (see FIG. 2A-3) that provides access to the interior chamber 590 and allows the battery 94 therein to be replaced. In the embodiment illustrated, the door 514 is configured to be removed to replace the battery 94 and snapped into place after the battery 94 has been replaced. While illustrated as being formed in the side of the battery compartment 520, the door 514 may be positioned elsewhere on the battery compartment 520.

Figure 9:
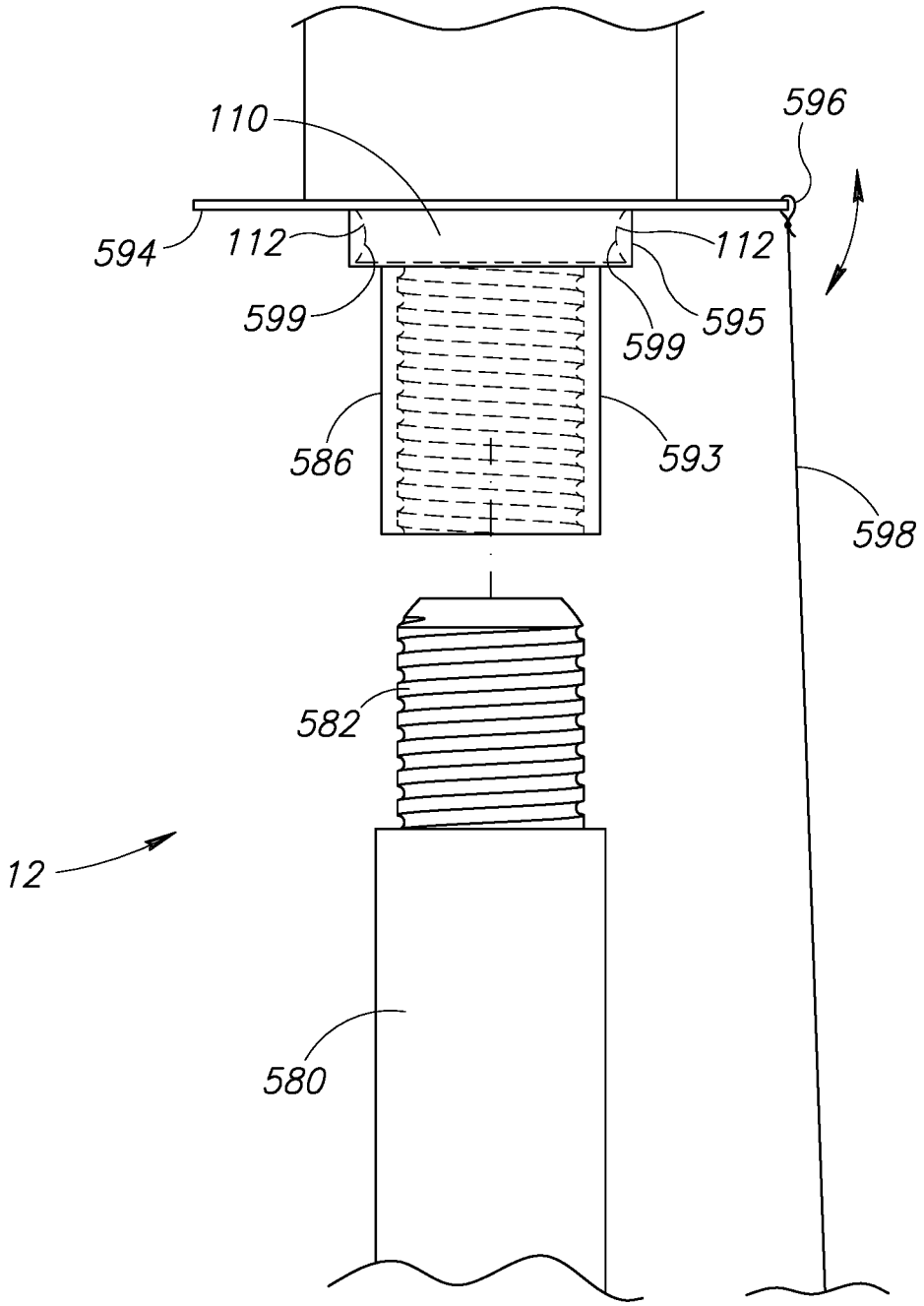
FIG. 9 is an enlarged partially exploded side view of the tool of FIG. 1.

FIG. 9 is an enlarged partially exploded side view of the tool 12 connected to the gripping portion 110. As shown in FIG. 9, the tool 12 may include a pole 580 that includes a threaded end portion 582. The threaded end portion 582 may thread into a threaded connector portion 586 of a battery compartment engaging portion 593. In the embodiment shown, the battery compartment engaging portion 593 has a cup shaped portion 595 with an outwardly extending flange 594 coupled thereto. A coupler 596 (e.g., a ring) is connected to the flange 594. A string or cord 598 extends downwardly from the coupler 596. The cord 598 may be pulled downwardly to open (or stretch) the cup shaped portion 595. Then, when the cord 598 is pulled downwardly, the gripping portion 110 may be inserted into the cup shaped portion 595. Next, the cord 598 may be released to allow the cup shaped portion 595 to grip the gripping portion 110. In the embodiment illustrated, the cup shaped portion 595 has convex shaped sidewalls 599 configured to conform to the concave sidewalls 112 formed in the gripping portion 110. At this point, the pole 580 with the connector portion 586 connected thereto may be rotated to disconnect the battery compartment 20 (or one of the removable battery compartments 220, 320, 420, and 520) from the housing body 50. Then, the battery 94 may be replaced and the battery compartment 20 (or one of the removable battery compartments 220, 320, 420, and 520) may be reconnected to the housing body 50.

Figure 10:
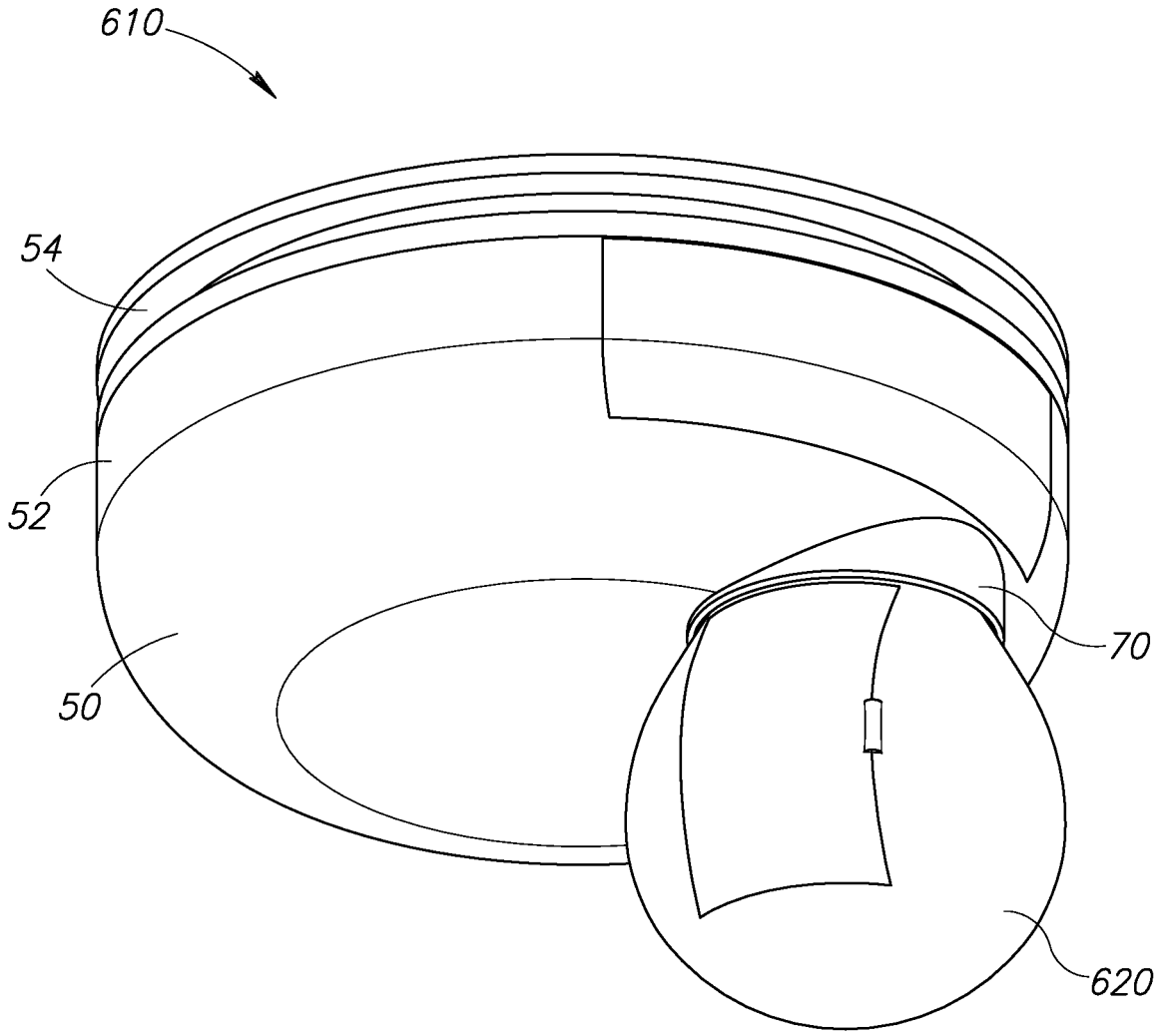
FIG. 10 is a perspective view of a fourth embodiment of a smoke detector.
Figure 11:
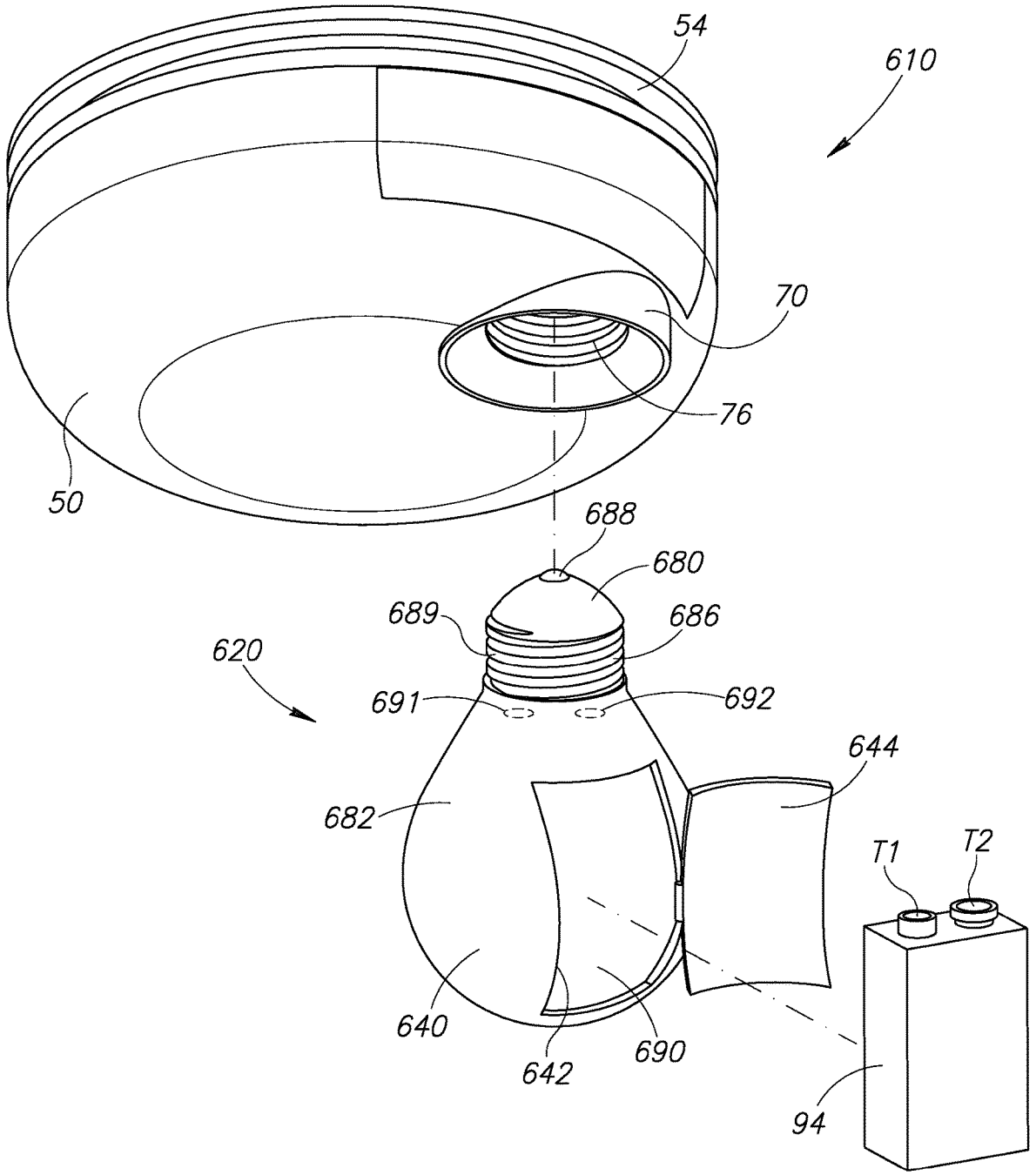
FIG. 11 is a partially exploded perspective view of the smoke detector of FIG. 10.
Figure 12A:
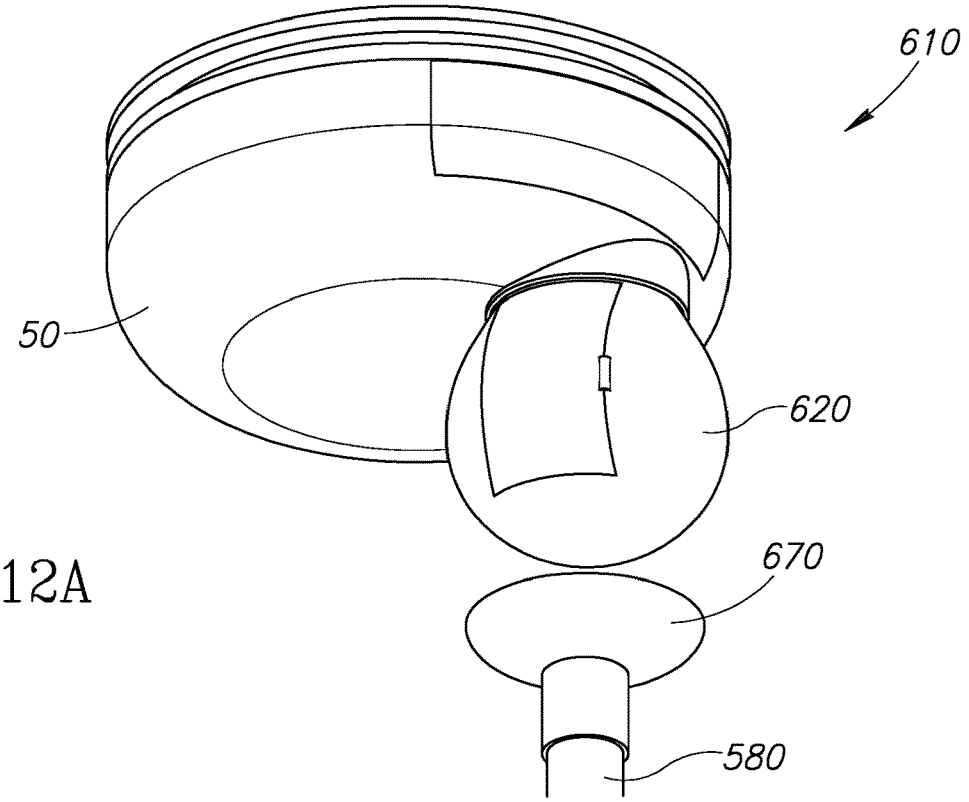
FIG. 12A is a perspective view of a standard light bulb removal tool being used to remove a removable battery compartment from the smoke detector of FIG. 10.
Figure 12B:
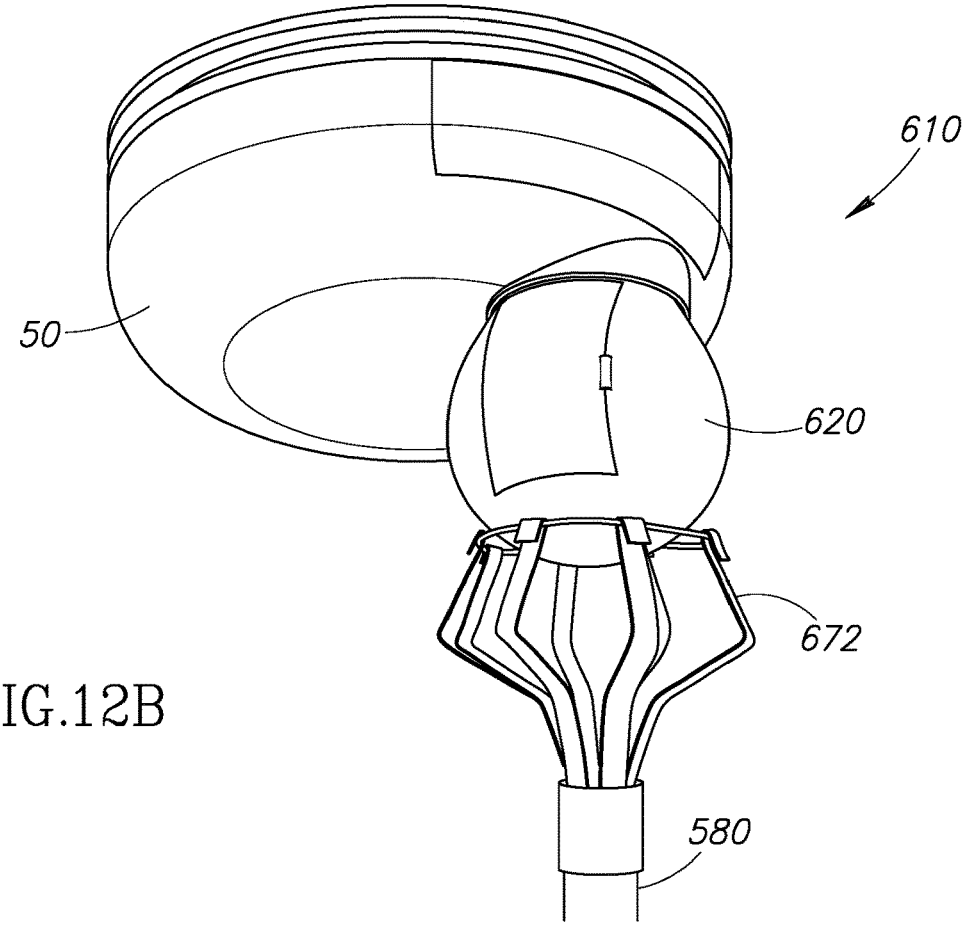
FIG. 12B is a perspective view of a standard light bulb removal tool being used to remove the removable battery compartment from the smoke detector of FIG. 10.

FIG. 10 is a perspective view of a fourth embodiment of a smoke detector 610. FIG. 11 is a partially exploded perspective view of the smoke detector 610. The smoke detector 610 is substantially similar to the smoke detector 30 (see FIGS. 1-2B) and like reference numerals have been used to identify like components in FIGS. 2A, 2B, 3, and 10-12B. However, the smoke detector 610 differs from the smoke detector 30 (see FIGS. 1-2B) with respect to its removable battery compartment 620. As shown in FIGS. 10-12B, the battery compartment 620 is substantially light bulb shaped.

Referring to FIG. 11, the battery compartment 620 has a threaded connector portion 680 and a battery compartment portion 682. The threaded connector portion 680 is substantially similar to a threaded portion or base of a standard light bulb (e.g., a standard base, an appliance size base, a smaller base, and the like). The threaded connector portion 680 has outside threads 686 configured to mate with the inside threads 76 of the threaded connector portion 70. Thus, the threaded connector portion 680 is configured to be threadedly engaged with the threaded connector portion 70.

Electrical connections 688 and 689 are positioned on the threaded connector portion 680. The electrical connections 688 and 689 physically contact and form electrical connections with the electrical connections 78 and 79 (see FIGS. 2B, 8, 13B, and 22), respectively, when the threaded connector portion 680 is fully threaded to the threaded connector portion 70. The electrical connections 688 and 689 are substantially similar to electrical connections of a standard light bulb, and (as mentioned above) the electrical connections 78 and 79 are substantially similar to electrical connections of a standard light bulb socket. Thus, the electrical connection 689 may include or be formed by the outside threads 686, and the electrical connection 78 may include or be formed by the inside threads 76.

The battery compartment portion 682 includes an interior chamber 690 configured to house the battery 94 and electrical connections 691 and 692 positioned to physically contact and form electrical connections with the battery terminals T1 and T2, respectively. The electrical connections 691 and 692 electrically interconnect the battery terminals T1 and T2 with the electrical connections 688 and 689, respectively.

Thus, the battery compartment 620 includes contacts (the electrical connections 688 and 689) on its outer upper surface configured to contact and form electrical connections with corresponding contacts (the electrical connections 78 and 79) mounted to the inside of the housing base 54. Additionally, the contacts (the electrical connections 78 and 79) inside the housing base 54 are connected to the smoke detector system 60 (as described above) inside the smoke detector 610.

Referring to FIG. 11, the interior chamber 690 is defined by a sidewall 640 with an opening 642 formed therein. The opening 642 is configured to allow the battery 94 to pass therethrough unobstructed into and out of the interior chamber 690. A door 644 is hingedly coupled to the sidewall 640 along an edge of the opening 642. The door 644 is configured to be selectively rotated between an open position (see FIG. 11) and a closed position (see FIG. 10).

Like the battery compartment 20 (see FIGS. 2A-3), the battery compartment 620 may be removed from the housing body 50 by the tool 12 (see FIG. 1). However, as shown in FIGS. 10-12B, the battery compartment 620 does not include the gripping portion 110 (see FIGS. 2A-4 and 5B-8). Instead, the pole 580 (see FIGS. 1, 9, 12A, 12B, and 13A) may be attached a suction cup style light bulb engaging portion 670 (see FIG. 12A), a basket style light bulb engaging portion 672 (see FIG. 12B), and the like that is used to grip the outside of the battery compartment 620 in the same manner a light bulb would be gripped. Thus, the battery compartment 620 may be selectively coupled to and uncoupled from the smoke detector 610 without the use of a ladder. When the battery compartment 620 is uncoupled from the smoke detector 610, the battery 94 (see FIG. 11) may be replaced.

Figure 13A:
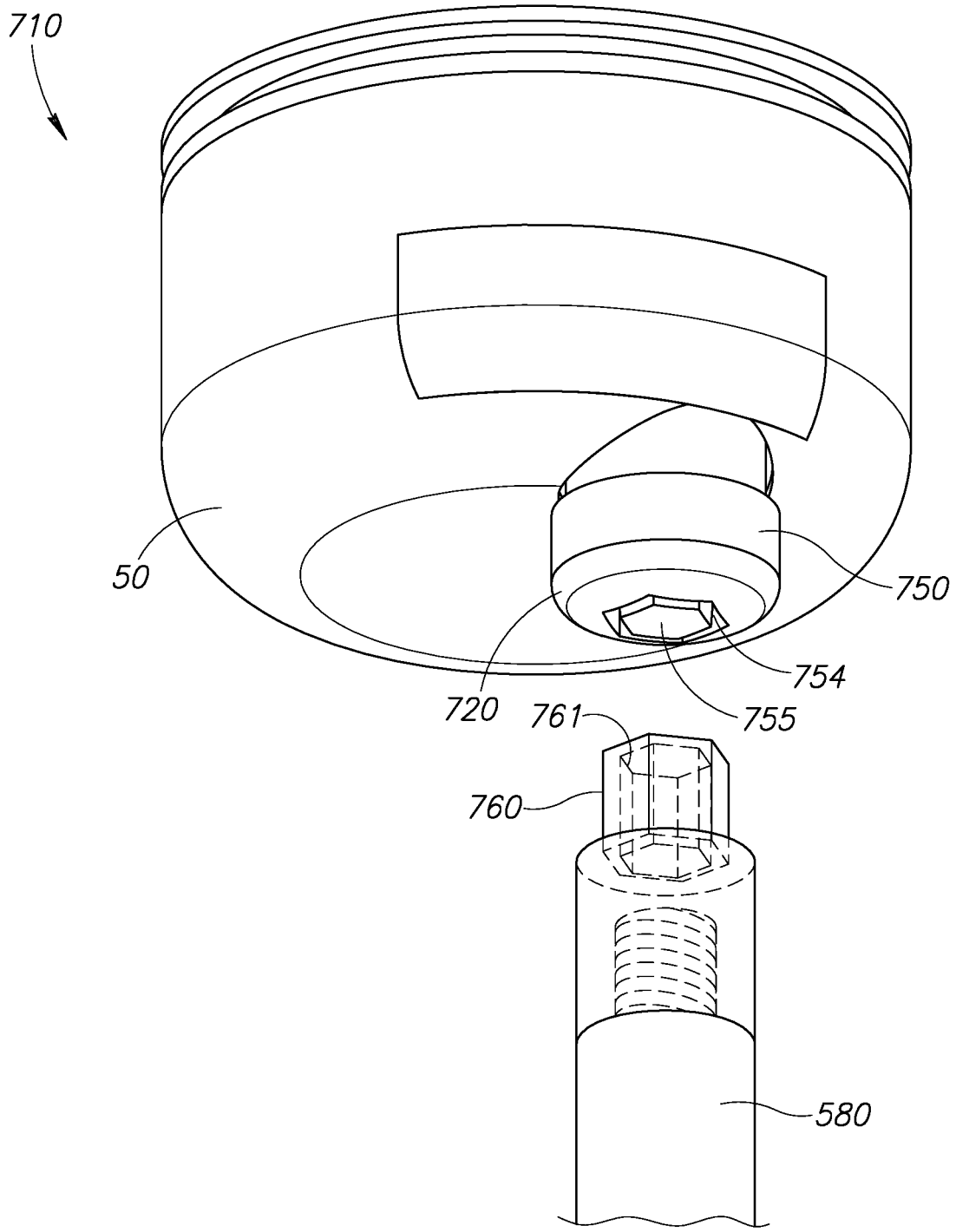
FIG. 13A is a perspective view of a fifth embodiment of a smoke detector.
Figure 13B:
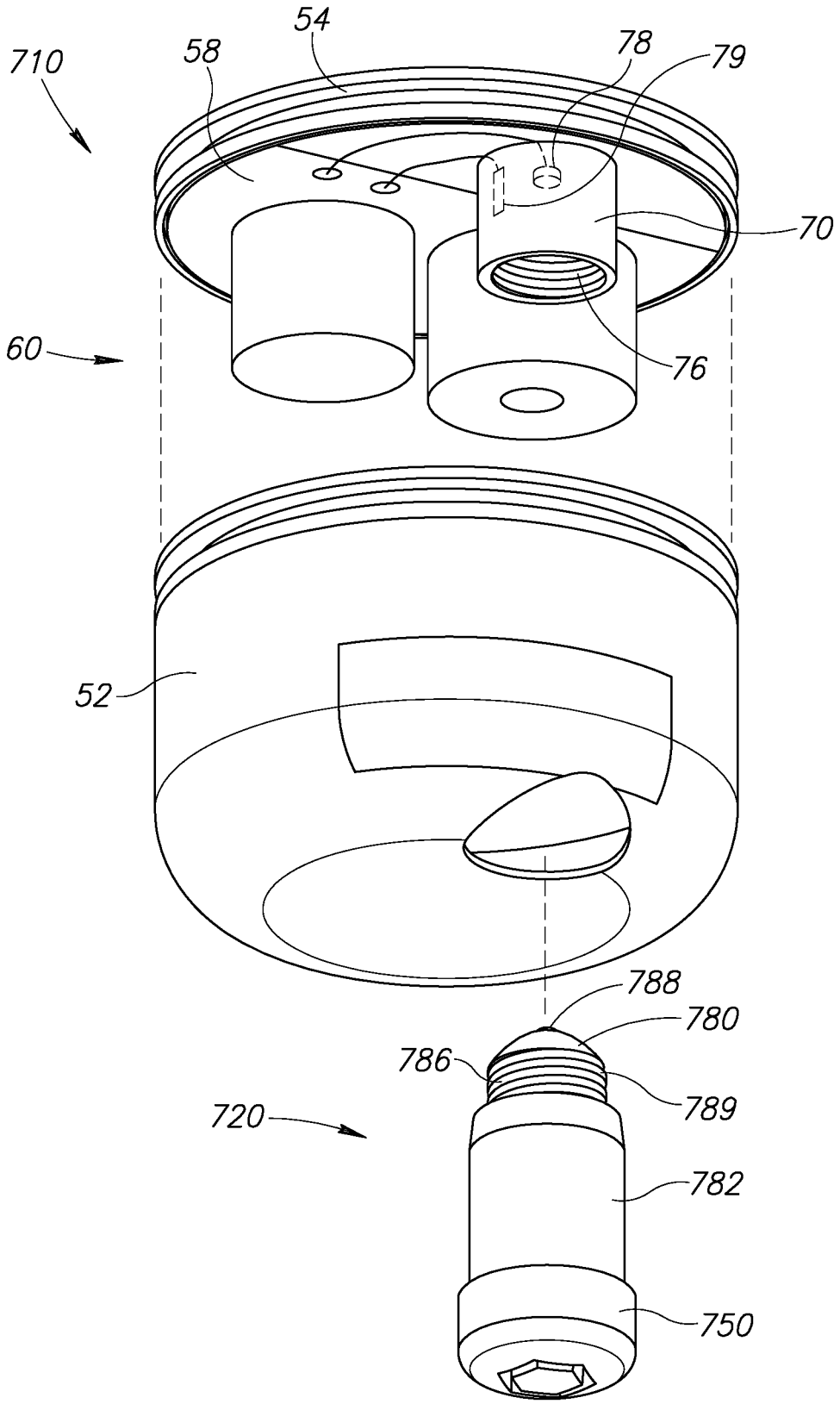
FIG. 13B is a partially exploded perspective view of the smoke detector of FIG. 13A.

FIG. 13A is a perspective view of a fifth embodiment of a smoke detector 710 that is substantially similar to the smoke detector 30 (see FIGS. 1-2B) and like reference numerals have been used to identify like components in FIGS. 2A, 2B, 3, and 13A-14B. The smoke detector 710 differs from the smoke detector 30 with respect to its removable battery compartment 720. Referring to FIG. 13B, the battery compartment 720 has a threaded connector portion 780 and a battery compartment portion 782. The threaded connector portion 780 is substantially similar to a threaded portion or base of a standard light bulb (e.g., a standard base, an appliance size base, a smaller base, and the like). The threaded connector portion 780 has outside threads 786 configured to mate with the inside threads 76 of the threaded connector portion 70. Thus, the threaded connector portion 780 is configured to be threadedly engaged with the threaded connector portion 70.

Figure 14A:
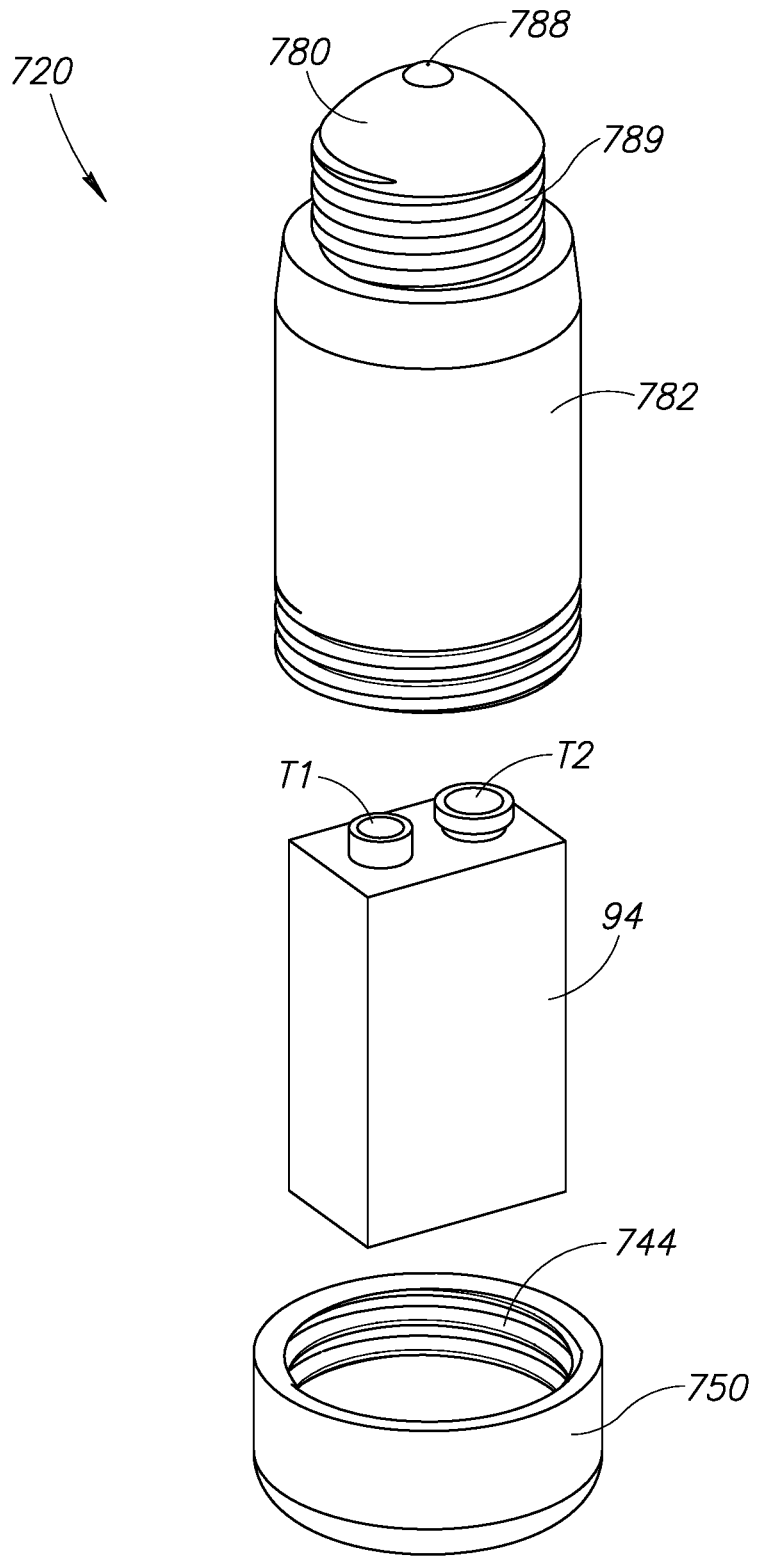
FIG. 14A is an exploded perspective view of a first embodiment of a removable battery compartment for use with the smoke detector of FIG. 13A.
Figure 14B:
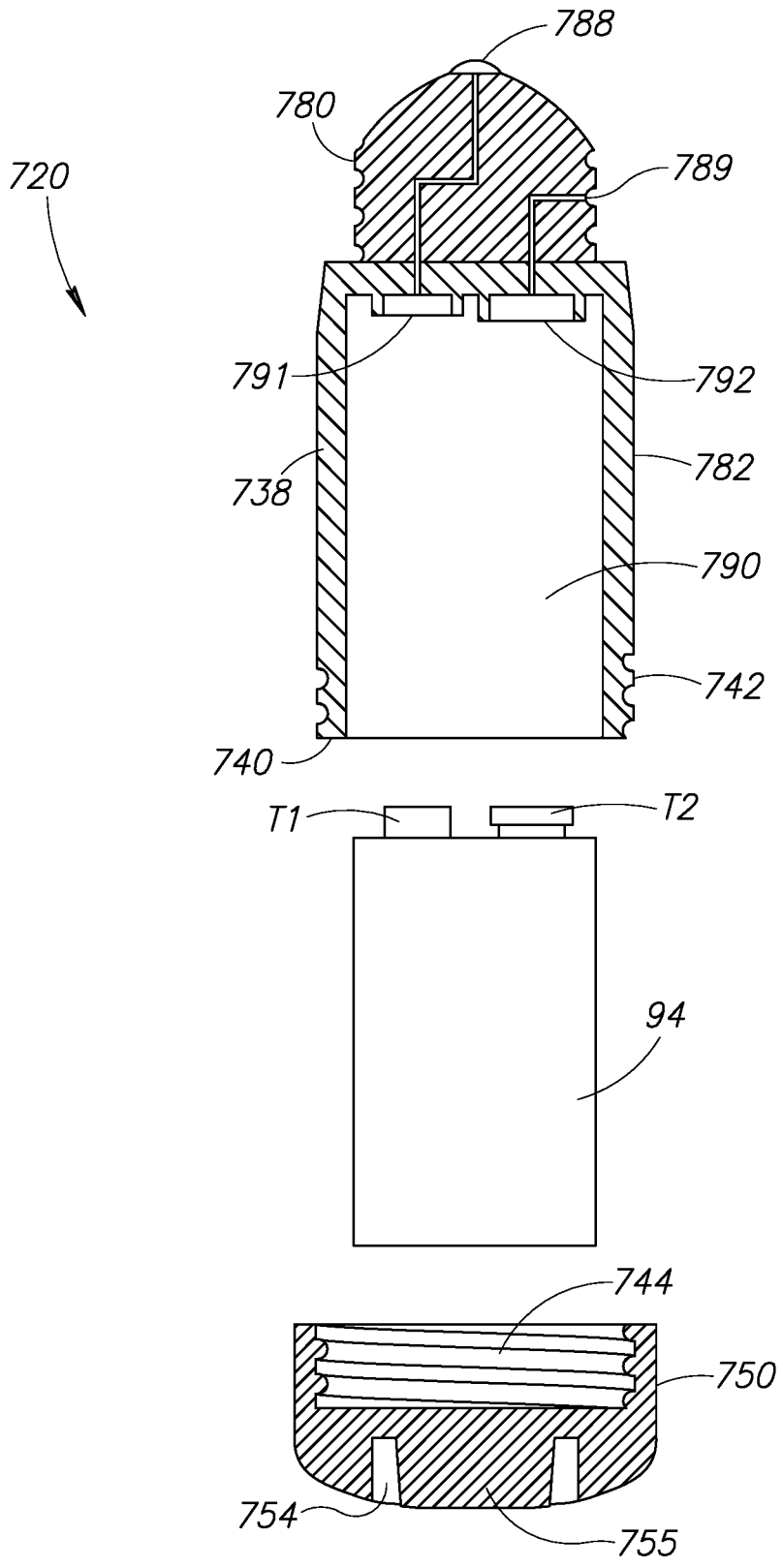
FIG. 14B is an exploded side cross-sectional view of the removable battery compartment of FIG. 14A.
Figure 15:
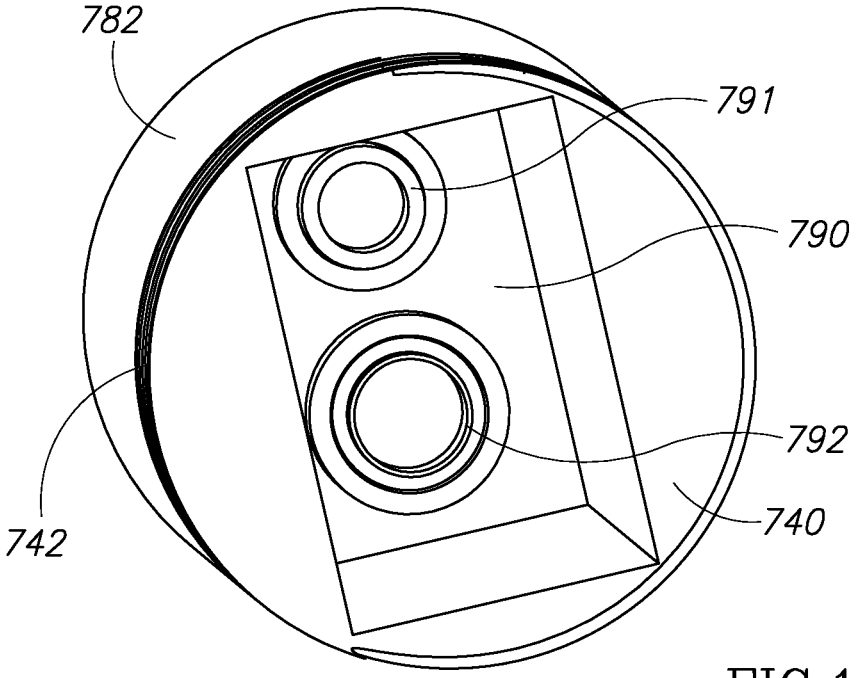
FIG. 15 is a perspective view into an interior chamber of the removable battery compartment of FIG. 14A.

Referring to FIG. 14B, electrical connections 788 and 789 are positioned on the threaded connector portion 780 and are substantially identically to the electrical connections 88 and 89 (see FIGS. 2B, 3, and 8), respectively. Thus, referring to FIG. 13B, the electrical connections 788 and 789 physically contact and form electrical connections with the electrical connections 78 and 79, respectively, when the threaded connector portion 780 is fully threaded to the threaded connector portion 70.

Referring to FIG. 14B, the battery compartment portion 782 includes an interior chamber 790 configured to house the battery 94 and electrical connections 791 and 792 positioned to physically contact and form electrical connections with the battery terminals T1 and T2, respectively. The electrical connections 791 and 792 electrically interconnect the battery terminals T1 and T2 with the electrical connections 788 and 789, respectively.

The interior chamber 790 has a sidewall 738 with an open end 740. The open end 740 is opposite the threaded connector portion 780 and is configured to allow the battery 94 to pass therethrough unobstructed into and out of the interior chamber 790. Outside threads 742 may be formed in the sidewall 738 along the open end 740. The battery compartment 720 includes a removable cap 750 configured to receive and close the open end 740 of the interior chamber 790. The cap 750 traps the battery 94 inside the interior chamber 790 and may push the battery terminals T1 and T2 into engagement with the electrical connections 791 and 792, respectively. Optionally, inside threads 744 may be formed in the cap 750. The inside threads 744 may be configured to mate with the outside threads 742 formed in the sidewall 738 along the open end 740.

In this embodiment, the gripping portion 110 (see FIGS. 2A-4 and 5B-8) is omitted. Instead, referring to FIG. 13A, the cap 750 has a recessed portion 754 configured to receive an attachment 760 attached to the pole 580. The attachment 760 is configured to be received inside the recessed portion 754 and rotate the battery compartment 720 with respect to the threaded connector portion 70 (see FIG. 13B). Thus, the battery compartment 720 may be selectively coupled to and uncoupled from the smoke detector 710 without the use of a ladder. When the battery compartment 720 is uncoupled from the smoke detector 710, the battery 94 may be replaced. In the embodiment illustrated, the cap 750 has a raised portion 755 positioned inside the recessed portion 754 and the attachment 760 has a central opening or recess 761 configured to receive the raised portion 755. However, this is not a requirement. Further, in the embodiment illustrated, both the recessed portion 754 and the attachment 760 are generally hex shaped. However, this is not a requirement.

Figure 16:
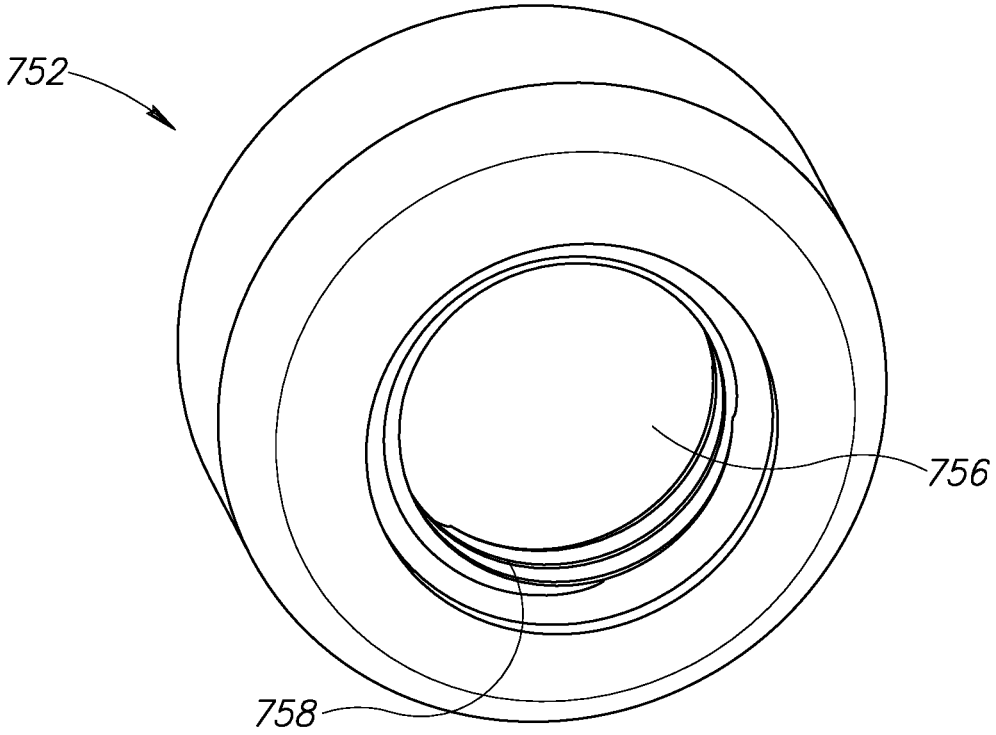
FIG. 16 is a perspective view of an alternate embodiment of a cap for use the removable battery compartment of FIG. 14A.

FIG. 16 is alternate embodiment of a cap 752 that may be used instead and in place of the cap 750 (see FIGS. 13A-14B). The cap 752 is substantially identical to the cap 750 except the cap 752 includes a recess 756 instead and in place of the recessed portion 754 (see FIGS. 13A, 14B, 17, and 18). The recess 756 includes inside threads 758. In such embodiments, the attachment 760 (see FIG. 13A) includes outside threads (not shown) configured to thread into the inside threads 758. When the attachment 760 (see FIG. 13A) is threaded into the cap 752, the pole 580 may be rotated by the user 10 (see FIG. 1) to thereby rotate the battery compartment 720 (see FIGS. 13A-14B). Thus, the battery compartment 720 may be selectively coupled to and uncoupled from the smoke detector 710 by the attachment 760 (see FIG. 13A) without the use of a ladder. When the battery compartment 720 is uncoupled from the smoke detector 710, the battery 94 may be replaced.

Figure 17:
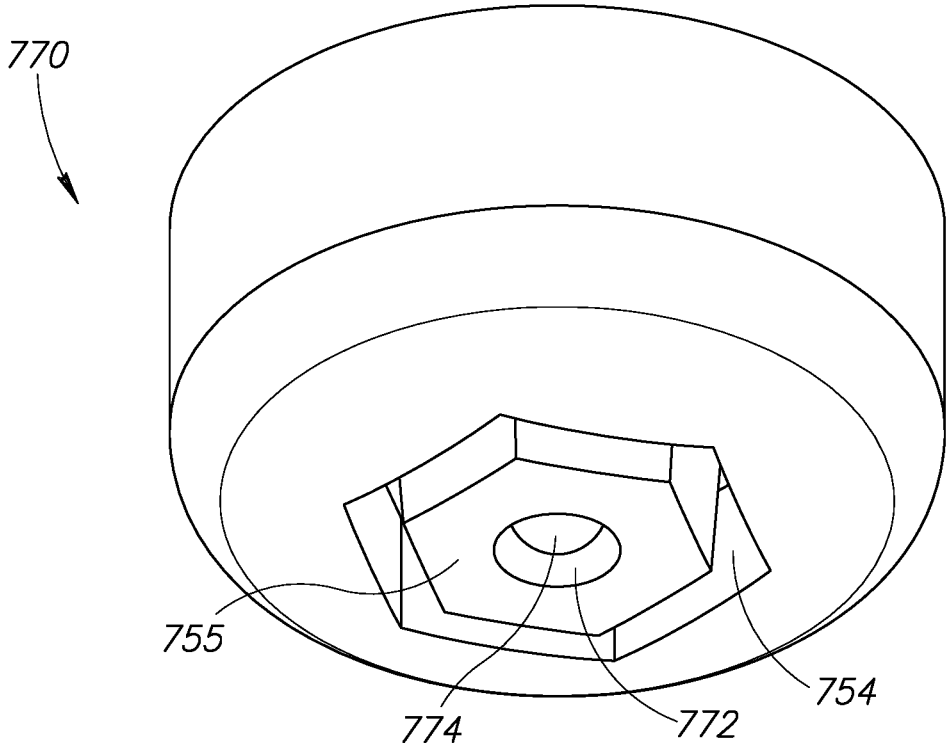
FIG. 17 is a perspective view of an alternate embodiment of a cap for use the removable battery compartment of FIG. 14A.
Figure 18:
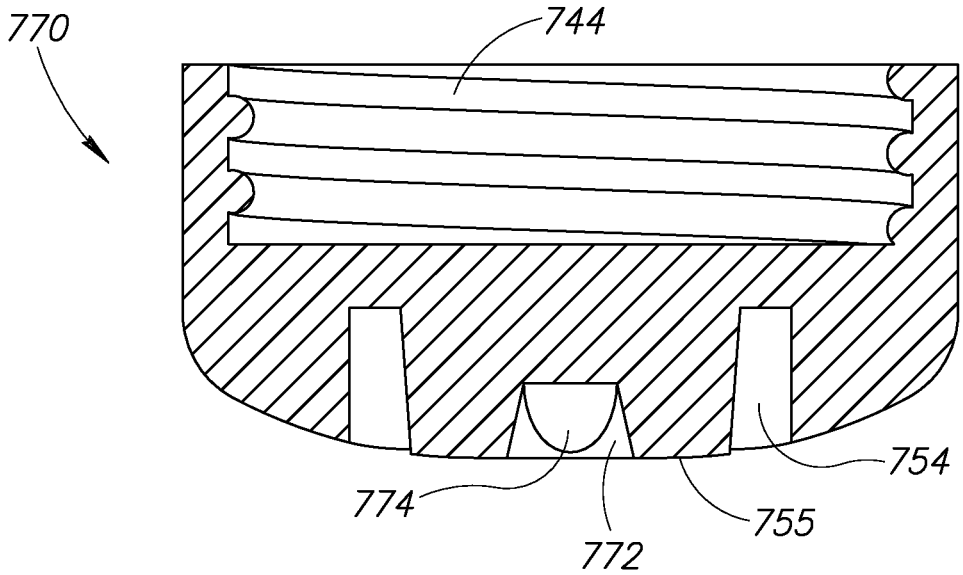
FIG. 18 is a side cross-sectional view of the cap of FIG. 17.

FIGS. 17 and 18 depict an alternate embodiment of a cap 770 that may be used instead and in place of the cap 750 (see FIGS. 13A-14B). The cap 770 is substantially identical to the cap 750 except the raised portion 755 of the cap 770 includes a recess 772 configured to house a light source 774 (e.g., a light emitting diode ("LED")). The battery 94 (see FIGS. 3, 4, 6-8, 11, and 14A-14B) provides power to the light source 774. The light source 774 may light up when the battery 94 should be replaced. By way of a non-limiting example, a circuit 1100 (see FIG. 24) may be used to illuminate the light source 774. By way of another non-limiting example, the light source 774 may light up and blink before the audible low-battery sound indicator sounds (e.g., chirps) to indicate the battery 94 needs replacement. Alternatively, the light source 774 may remain lit until the battery 94 should be replaced. In such embodiments, when the light source 774 is off (or no longer lit), the battery 94 should be replaced. The recessed portion 754 is configured to receive the attachment 760 (see FIG. 13A), which may be used to rotate the battery compartment 720 (see FIGS. 13A-14B) with respect to the threaded connector portion 70 (see FIG. 13B). Thus, the battery compartment 720 (see FIGS. 13A-14B) may be selectively coupled to and uncoupled from the smoke detector 710 (see FIGS. 13A and 13B) without the use of a ladder.

Figure 19A:
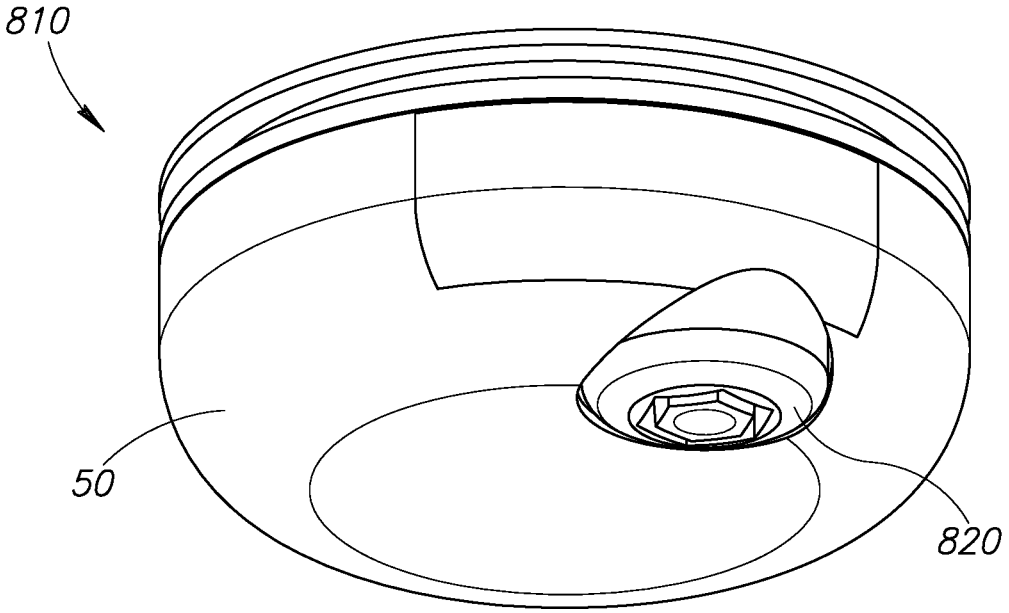
FIG. 19A is a perspective view of a sixth embodiment of a smoke detector.

FIG. 19A is a perspective view of a sixth embodiment of a smoke detector 810 that is substantially similar to the smoke detector 30 (see FIGS. 1-2B) and like reference numerals have been used to identify like components in FIGS. 2A, 2B, 19A, and 19B. The smoke detector 810 differs from the smoke detector 30 in two respects. First, referring to FIG. 19B, the smoke detector 810 includes a connector portion 870 instead and in place of the threaded connector portion 70 (see FIGS. 2B, 8, 10, 11, 13B, and 22). Second, the smoke detector 810 includes a removable battery compartment 820 instead and in place of the battery compartment 20 (see FIGS. 2A-3).

The connector portion 870 includes one or more outwardly extending pegs 872 and an inwardly extending channel 874. The channel 874 has an opening 876. A first electrical connection 878 is housed inside the channel 874 (e.g., opposite the opening 876). A second electrical connection 879 is positioned on or includes one of the pegs 872. The electrical connections 62 and 63 (e.g., wires) physically contact and form electrical connections with the electrical connections 878 and 879, respectively. The electrical connections 62 and 63 receive power from the electrical connections 878 and 879, respectively, and conduct that power to the electrical contacts 64 and 65, respectively. Thus, power may be transmitted from the electrical connections 878 and 879 to the electrical contacts 64 and 65, respectively, and onward to at least some of the components of the smoke detector system 60.

The battery compartment 820 is configured to be manufactured, used, and discarded as a single unit. Further, referring to FIG. 19A, the battery compartment 820 may be shorter and slightly recessed into the housing body 50. Referring to FIG. 20B, the battery compartment 820 includes one or more batteries 822 instead and in place of the battery 94 (see FIGS. 3, 4, 6-8, 11, and 14A-14B). For ease of illustration, the battery compartment 820 will be described as housing a single battery 822. The battery 822 is not replaced. Instead, the entire battery compartment 820 is removed and replaced when the battery 822 has been depleted. By way of a non-limiting example, the battery 822 may be molded inside the battery compartment 820 when the battery compartment 820 is constructed.

Figure 20A:
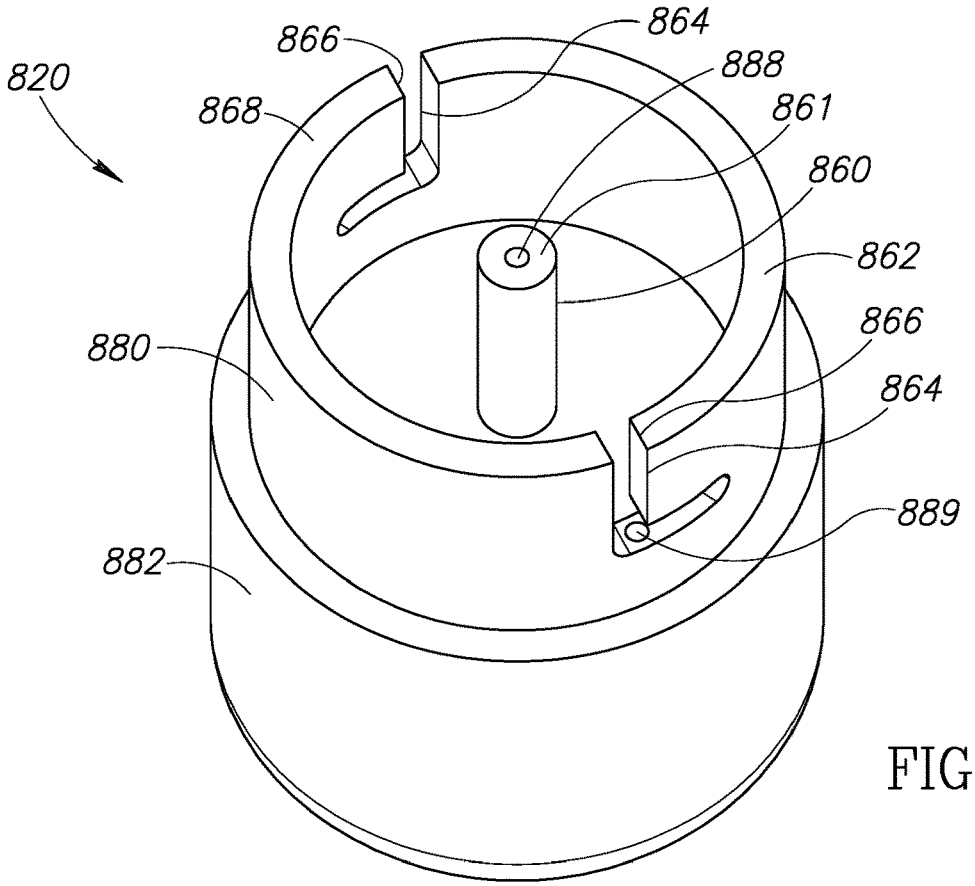
FIG. 20A is a perspective view of a first embodiment of a removable battery compartment for use with the smoke detector of FIG. 19A.
Figure 20B:
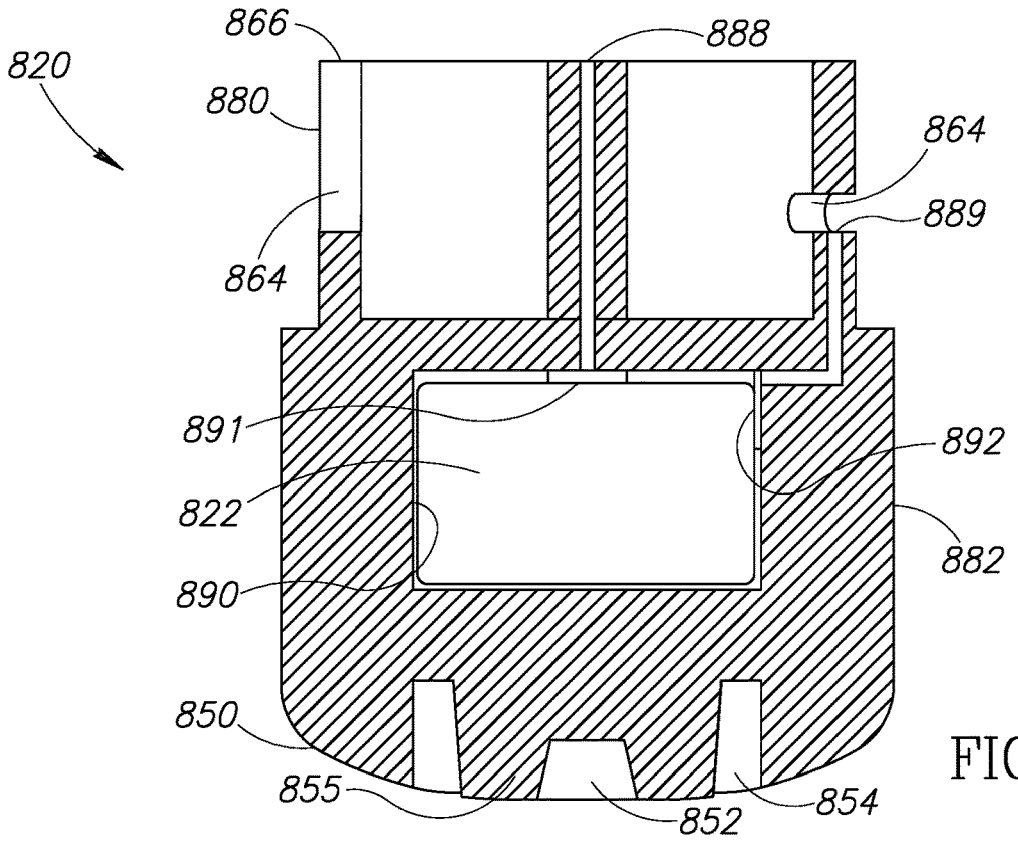
FIG. 20B is a side cross-sectional view of the removable battery compartment of FIG. 20A.

Referring to FIG. 20A, the battery compartment 820 has a connector portion 880 and a battery compartment portion 882. The connector portion 880 has a projection 860 and a sidewall 862 that is concentric with the projection 860. The projection 860 has a free end 861 opposite the battery compartment portion 882.

Figure 19B:
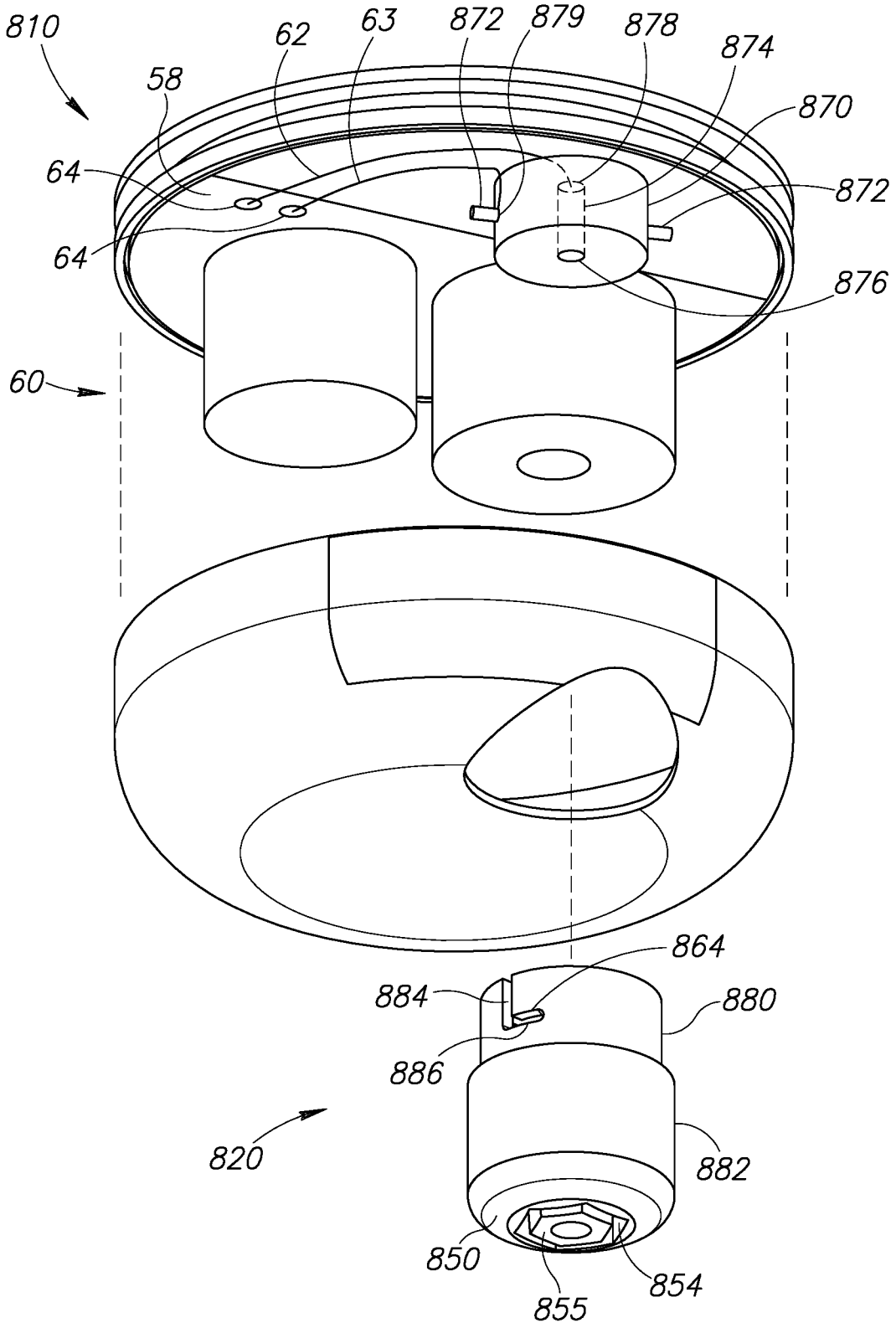
FIG. 19B is a partially exploded perspective view of the smoke detector of FIG. 19A.

A slot 864 formed is formed in the sidewall 862 for each of the pegs 872 (see FIG. 19B). Each slot 864 has an opening 866 formed along an edge 868 of the sidewall 862. Each opening 866 opens into a first part 884 (see FIG. 19B) of the slot 864. A second part 886 (see FIG. 19B) of the slot 864 is at an angle (e.g., perpendicular) to the first part 884 (see FIG. 19B). Referring to FIG. 19B, the battery compartment 820 is coupled to the connector portion 870 by inserting the pegs 872 into the openings 866 (see FIG. 20A) of the slots 864 until the pegs 872 are adjacent the second parts 886 (see FIG. 19B) of the slots 864. Then, the battery compartment 820 is rotated with respect to the connector portion 870 to slide the pegs 872 from the first parts 884 (see FIG. 19B) into the second parts 886 (see FIG. 19B) of the slots 864.

Referring to FIGS. 20A and 20B, electrical connections 888 and 889 are positioned on the connector portion 880. The electrical connections 888 and 889 physically contact and form electrical connections with the electrical connections 878 and 879 (see FIG. 19B), respectively, when the connector portion 880 is coupled to the connector portion 870 (see FIG. 19B). In the embodiment illustrated, the electrical connection 888 is positioned on the free end 861 of the projection 860 and the electrical connection 889 is positioned in one of the slots 864.

Referring to FIG. 20B, the battery compartment portion 882 includes an interior chamber 890 configured to house the battery 822. The battery compartment portion 882 includes electrical connections 891 and 892 positioned to physically contact and form electrical connections with battery terminals or contacts of the battery 822. The electrical connections 891 and 892 electrically interconnect the battery contacts with the electrical connections 888 and 889, respectively. The electrical connections 888 and 889 transmit power to the electrical connections 878 and 879 (see FIG. 19B), respectively, which in turn, transmit the power to at least some of the components of the smoke detector system 60.

Referring to FIG. 19B, the battery compartment portion 882 has a lower portion 850 opposite the connector portion 880. The lower portion 850 has a recessed portion 854 substantially identical to the recessed portion 754 (see FIGS.

13A, 14B, 17, and 18) and configured to receive the attachment 760 (see FIG. 13A) attached to the pole 580 (see FIGS. 1, 9, 12A, 12B, and 13A). The attachment 760 (see FIG. 13A) is configured to be received inside the recessed portion 854 and to rotate the battery compartment 820 with respect to the connector portion 870. Thus, the battery compartment 820 may be selectively coupled to and uncoupled from the smoke detector 810 without the use of a ladder. In the embodiment illustrated, the lower portion 850 has a raised portion 855 positioned inside the recessed portion 854 and configured to be received inside the central recess 761 (see FIG. 13A) of the attachment 760 (see FIG. 13A). However, this is not a requirement. Further, in the embodiment illustrated, the recessed portion 854 is generally hex shaped. However, this is not a requirement.

Figure 21:
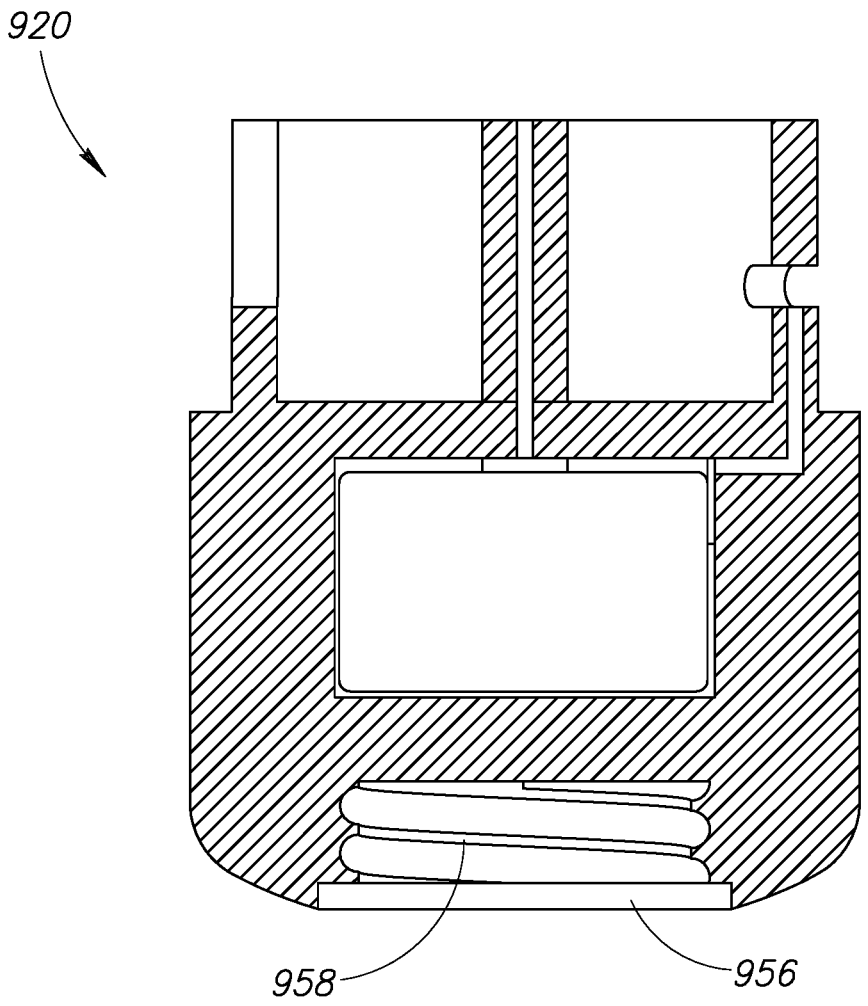
FIG. 21 is a perspective view of a second embodiment of a removable battery compartment for use with the smoke detector of FIG. 19A.

FIG. 21 depicts an alternate embodiment of a removable battery compartment 920 that may be used instead and in place of the battery compartment 820 (see FIGS. 19A-20B). The battery compartment 920 is substantially identical to the battery compartment 820 (see FIGS. 19A-20B) except the battery compartment 920 includes a recess 956 (substantially identical to the recess 756 depicted in FIG. 16) instead and in place of the recessed and raised portions 854 and 855 (see FIGS. 19B and 20B). The recess 956 includes inside threads 958. In such embodiments, the attachment 760 (see FIG. 13A) includes outside threads (not shown) configured to thread into the inside threads 958. Thus, the attachment 760 (see FIG. 13A) is configured to be received inside the recess 956 and to rotate the battery compartment 920 with respect to the connector portion 870 (see FIG. 19B). In this manner, the battery compartment 920 may be selectively coupled to and uncoupled from the smoke detector 810 (see FIGS. 19A and 19B) by the attachment 760 (see FIG. 13A) without the use of a ladder.

Referring to FIG. 20B, by way of yet another non-limiting example, the raised portion 855 may include a recess 852 (substantially identical to the recess 772 illustrated in FIGS. 17 and 18) configured to house the light source 774 (see FIGS. 17 and 18). The battery 822 may be configured to provide power to the light source 774 (see FIGS. 17 and 18). The light source 774 may light up when the battery 822 should be replaced. By way of a non-limiting example, the circuit 1100 (see FIG. 24) may be used to illuminate the light source 774. By way of another non-limiting example, the light source 774 may light up and blink before the audible low-battery sound indicator sounds (e.g., chirps) to indicate the battery 822 needs replacement. Alternatively, the light source 774 may remain lit until the battery 822 should be replaced. In such embodiments, when the light source 774 is off, the battery 822 should be replaced.

Figure 22:
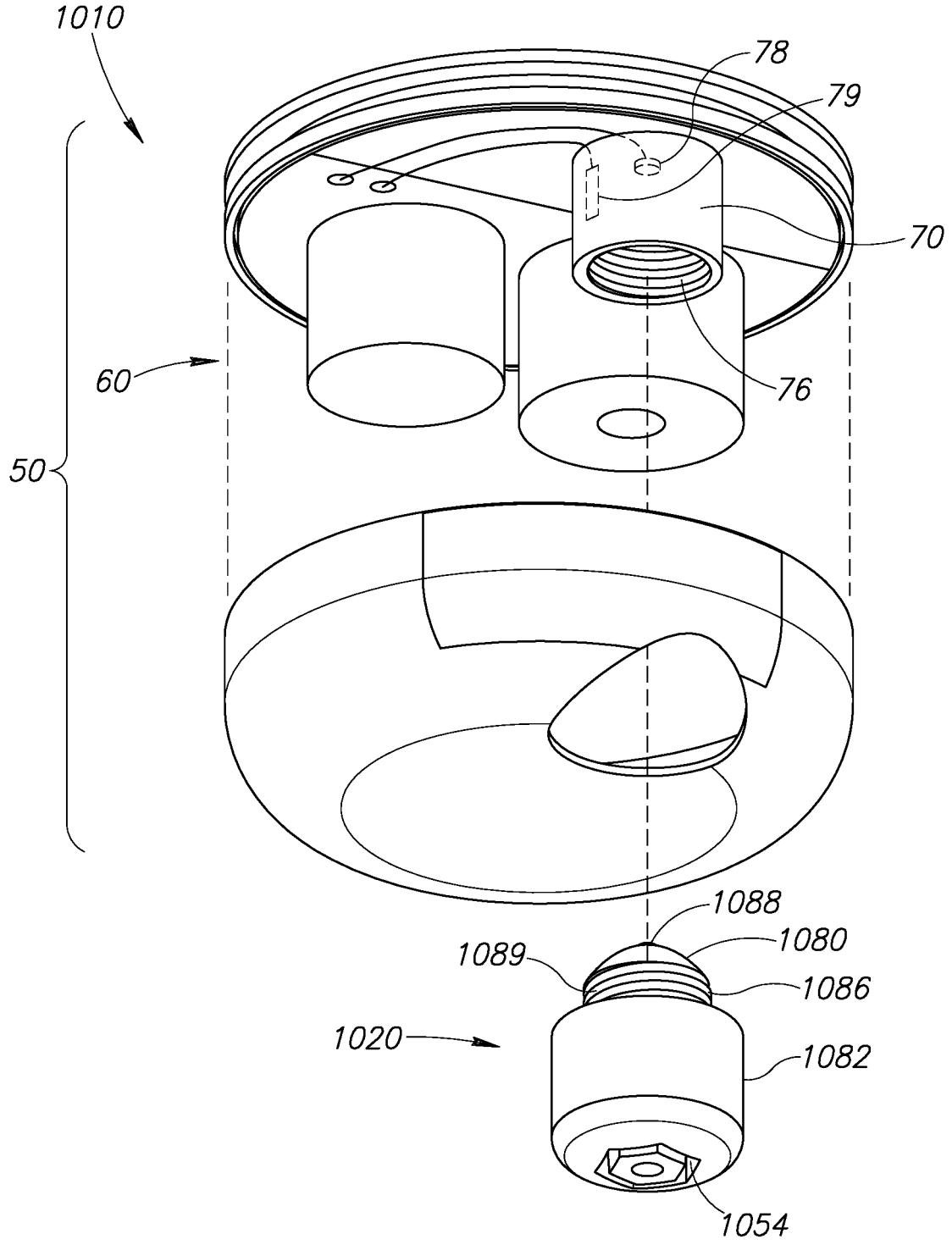
FIG. 22 is a partially exploded perspective view of a seventh embodiment of a smoke detector.

FIG. 22 is a perspective view of a seventh embodiment of a smoke detector 1010 that is substantially similar to the smoke detector 30 (see FIGS. 1-2B) and like reference numerals have been used to identify like components in FIGS. 2A, 2B, and 22. The smoke detector 1010 differs from the smoke detector 30 (see FIGS. 1-2B) with respect to its removable battery compartment 1020. The battery compartment 1020 is configured to be manufactured, used, and discarded as a single unit. Further, the battery compartment 1020 may be shorter and slightly recessed into the housing body 50 (like the battery compartment 820 shown in FIG. 19A).

The battery compartment 1020 has a threaded connector portion 1080 and a battery compartment portion 1082. The threaded connector portion 1080 is substantially similar to a threaded portion or base of a standard light bulb (e.g., a standard base, an appliance size base, a smaller base, and the like). The threaded connector portion 1080 has outside threads 1086 configured to mate with the inside threads 76 of the threaded connector portion 70. Thus, the threaded connector portion 1080 is configured to be threadedly engaged with the threaded connector portion 70.

Figure 23:
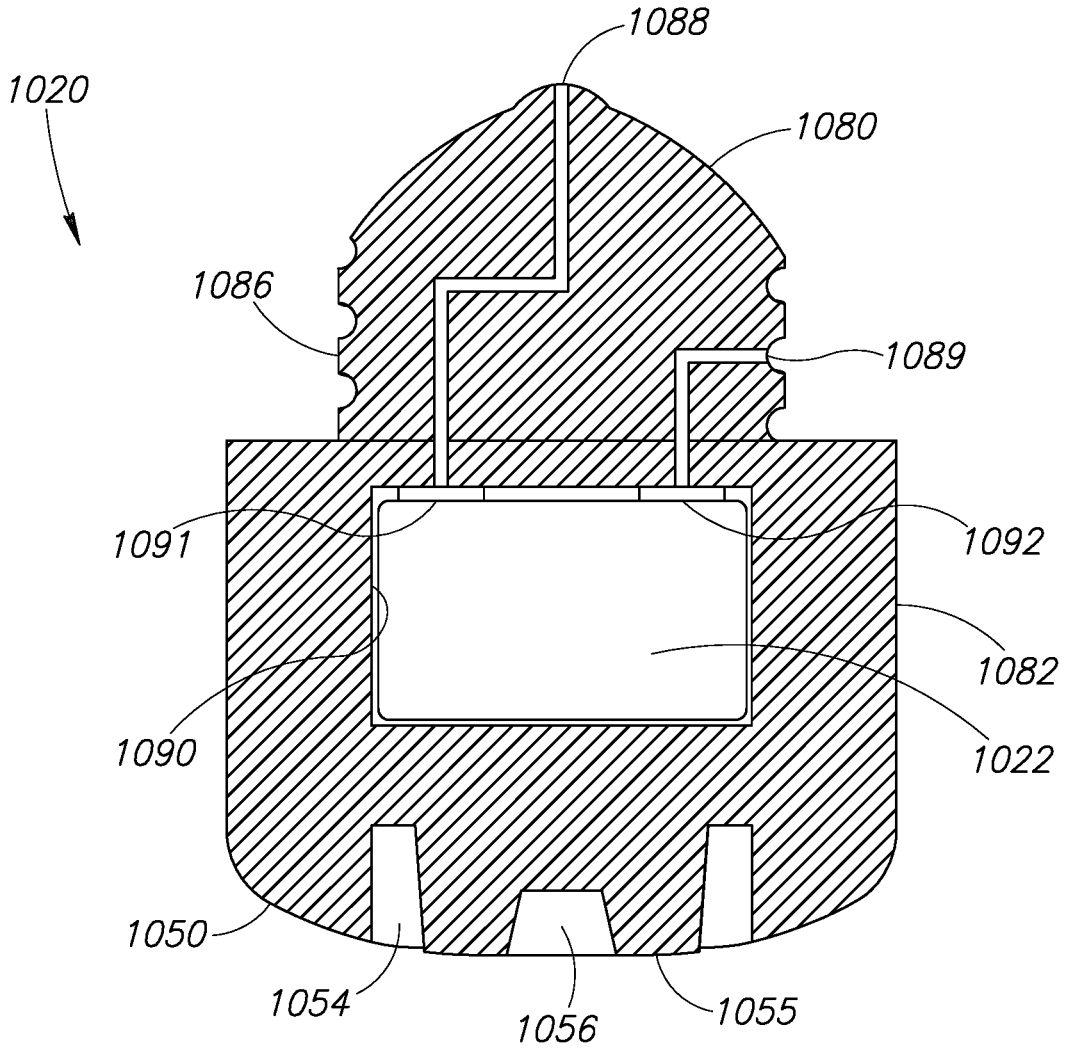
FIG. 23 is a perspective view of a removable battery compartment for use with the smoke detector of FIG. 22.

Referring to FIG. 23, electrical connections 1088 and 1089 are positioned on the threaded connector portion 1080 and are substantially identically to the electrical connections 88 and 89 (see FIGS. 2B, 3, and 8), respectively. Thus, referring to FIG. 22, the electrical connections 1088 and 1089 physically contact and form electrical connections with the electrical connections 78 and 79, respectively, when the threaded connector portion 1080 is fully threaded to the threaded connector portion 70.

Referring to FIG. 23, the battery compartment portion 1082 includes an interior chamber 1090 configured to house one or more batteries (e.g., a battery 1022). The battery compartment portion 1082 includes electrical connections 1091 and 1092 positioned to physically contact and form electrical connections with battery terminals or contacts of the battery 1022. The electrical connections 1091 and 1092 electrically interconnect the battery contacts of the battery 1022 with the electrical connections 1088 and 1089, respectively. Referring to FIG. 22, the electrical connections 1088 and 1089 transmit power to the electrical connections 78 and 79, respectively, which in turn, transmit the power to at least some of the components of the smoke detector system 60.

Referring to FIG. 23, the battery compartment portion 1082 has a lower portion 1050 opposite the connector portion 1080 that is substantially similar to the lower portion 850 (see FIGS. 19B and 20B). The lower portion 1050 has a recessed portion 1054 substantially identical to the recessed portion 754 (see FIGS. 13A, 14B, 17, and 18) and configured to receive the attachment 760 (see FIG. 13A) attached to the pole 580 (see FIGS. 1, 9, 12A, 12B, and 13A). Referring to FIG. 23, the attachment 760 (see FIG. 13A) is configured to be received inside the recessed portion 1054 and to rotate the battery compartment 1020 with respect to the threaded connector portion 70. Thus, the battery compartment 1020 may be selectively coupled to and uncoupled from the smoke detector 1010 without the use of a ladder. In the embodiment illustrated, referring to FIG. 23, the lower portion 1050 has a raised portion 1055 positioned inside the recessed portion 1054 and configured to be received inside the central recess 761 (see FIG. 13A) of the attachment 760 (see FIG. 13A). However, this is not a requirement. Further, in the embodiment illustrated, the recessed portion 1054 is generally hex shaped. However, this is not a requirement.

While not illustrated, the lower portion 1050 may include the recess 956 (see FIG. 21) with the inside threads 958 (see FIG. 21) instead and in place of the recessed and raised portions 1054 and 1055. By way of yet another non-limiting example, referring to FIG. 23, the raised portion 1055 may include a recess 1056 (substantially identical to the recess 772 illustrated in FIGS. 17 and 18) configured to house the light source 774 (see FIGS. 17 and 18). The battery 1022 may be configured to provide power to the light source 774 (see FIGS. 17 and 18). The light source 774 may light up when the battery 1022 should be replaced. By way of a non-limiting example, the circuit 1100 (see FIG. 24) may be used to illuminate the light source 774. By way of another non-limiting example, the light source 774 may light up and blink before the audible low-battery sound indicator sounds (e.g., chirps) to indicate the battery 1022 needs replacement. Alternatively, the light source 774 may remain lit until the battery 822 should be replaced. In such embodiments, when the light source 774 is off, the battery 822 should be replaced.

Figure 24:
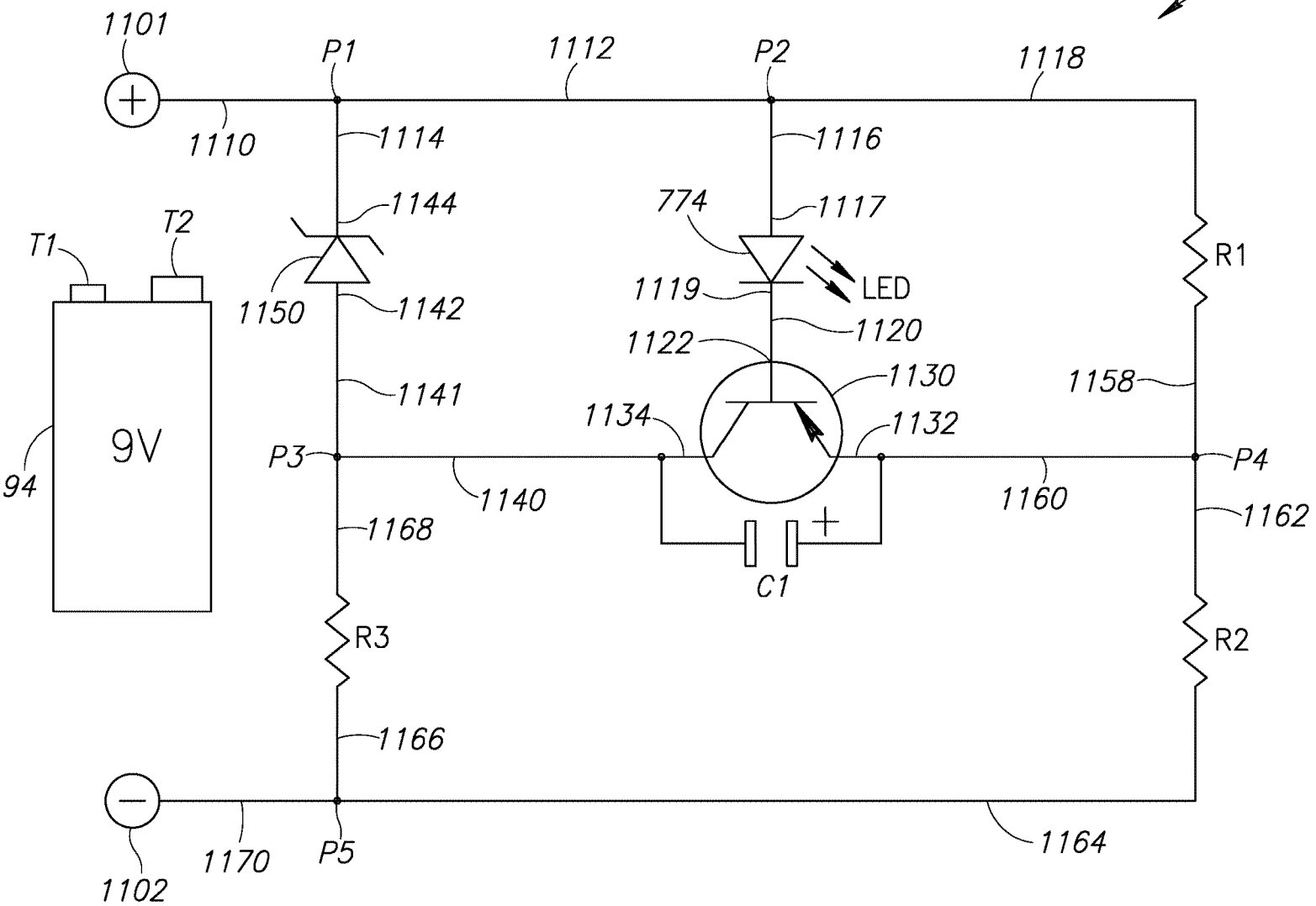
FIG. 24 is a circuit diagram of a circuit that may be used to power a light source when current available from the battery drops below a predetermined amount.

FIG. 24 is a circuit diagram of the circuit 1100 that may be used to power the light source 774 (illustrate as a light emitting diode). The circuit 1100 is configured to illuminate the light source 774 when a battery (e.g., the battery 94, the battery 822, the battery 1022, and the like) should be replaced. For ease of illustration, the circuit 1100 has been illustrated for use with the battery 94, which has been illustrated as being implemented as a conventional 9 Volt battery. However, the circuit 1100 may be configured for use with any type of battery (e.g., the battery 822, the battery 1022, and the like).

The circuit 1100 includes terminals or contacts 1101 and 1102 configured to physically contact and form electrical connections with the battery terminals T1 and T2, respectively. The contact 1101 is connected to a point P1 (e.g., by an electrical conductor 1110 such as a wire). Electrical conductors 1112 and 1114 (e.g., wires) are also connected to the point P1. The electrical conductor 1112 is also connected to a point P2. Electrical conductors 1116 and 1118 (e.g., wires) are also connected to the point P2.

The electrical conductor 1116 is connected to an anode 1117 of the light source 774. An electrical conductor 1120 connects a cathode 1119 of the light source 774 to a base 1122 of a transistor 1130 (e.g., a PNP transistor, such as a C106 transistor). Thus, when current flows through the light source 774 it enters the base 1122 of the transistor 1130.

An emitter 1132 and a collector 1134 of the transistor 1130 are both connected to a capacitor C1 (e.g., 100 microfarads (μF)). The collector 1134 is also connected to a point P3 by an electrical conductor 1140 (e.g., a wire). The point P3 is connected (by an electrical conductor 1141) to an anode 1142 of a Zener diode 1150 (e.g., having a Zener voltage of about 8.2 Volts). The cathode 1144 of the Zener diode 1150 is connected to the electrical conductor 1114.

As is apparent to those of ordinary skill in the art, a Zener diode permits current to flow from its anode 1142 to its cathode 1144 and also allows current to flow from its cathode 1144 to its anode 1142 when its "Zener voltage" is reached. Thus, when the battery 94 has more than the Zener voltage available (e.g., about 8.2 Volts), current flows from the point P1 to the point P3. However, when the battery 94 has less than the Zener voltage available, current may flow from the point P3 to the point P1.

The electrical conductor 1118 is connected to a resistor R1 (e.g., 6.8 Kilohms (kΩ)). The resistor R1 is also connected (by an electrical conductor 1158) to a point P4. The emitter 1132 is connected (by an electrical conductor 1160) to the point P4. The point P4 is also connected (by an electrical conductor 1162) to a resistor R2 (e.g., 1 kΩ). The resistor R2 is connected (by an electrical conductor 1164) to a point P5. The point P5 is also connected (by an electrical conductor 1166) to a resistor R3 (e.g., 1 kΩ). The resistor R3 is also connected (by an electrical conductor 1168) to the point P3. The contact 1102 is connected to the point P5 (e.g., by an electrical conductor 1170 such as a wire).

When the voltage available from the battery 94 is greater than the Zener voltage (e.g., about 8.2 Volts) of the Zener diode 1150, current flows through the Zener diode 1150 from the point P1 to the point P3. The current then passes through the resistor R3 to the point P5. The point P5 is connected to the contact 1102. No current flows through the light source 774.

On the other hand, when the voltage available from the battery 94 drops to below the Zener voltage (e.g., about 8.2 Volts) of the Zener diode 1150, current no longer flows through the Zener diode 1150 from the point P1 to the point P3. Instead, the current travels through the light source 774 illuminating it. Thus, the partially depleted battery 94 provides power to the light source 774 when the voltage available from the battery 94 drops to below a predetermined amount (e.g., the Zener voltage). In some embodiments, the circuit 1100 is configured to provide power (from the partially depleted battery 94) to the light source 774 when the voltage available from the battery 94 drops to below about 8.5 Volts.

While a number of tools have been disclosed for removing the various removable battery compartments, alternate tools may be used. For example, a tool typically used to remove a broken light bulb may be used. Such a tool may be used remove a removable battery compartment having a gripping portion that includes a concave opening with a rough textured interior configured to simulate or duplicate a broken light bulb base.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A smoke detector comprising:

a housing comprising a connector portion;

a removable battery compartment removably coupled to the connector portion, the battery compartment configured to house a battery and electrically connect the battery with the connector portion;

a gripping tool; wherein the battery compartment is configured to be removed from the connector portion of the housing by the gripping tool, the battery compartment having a cup shaped portion with an outwardly extending flange, a ring connected to the flange, and a cord extending downwardly from the ring wherein the cord is configured to be pulled downwardly to open the cup shaped portion such that when the cord is pulled downwardly, a gripping portion of the gripping tool is inserted into the cup shaped portion wherein when the cord is released the cup shaped portion is configured to grip the gripping portion, the cup shaped portion having convex shaped sidewalls configured to conform to concave sidewalls formed in the gripping portion of the gripping tool; and a smoke alarm system housed inside the housing and electrically connected to the connector portion, the smoke alarm system configured to detect smoke and sound an alarm when smoke is detected, the connector portion configured to receive power from the battery and supply the power to the smoke alarm system when the battery compartment is coupled to the connector portion, the battery compartment further comprising the battery non-removably housed therein, the battery is molded inside the battery compartment when the battery compartment is constructed, the battery compartment comprising a door configured to be selectively opened to replace the battery, the battery compartment comprising a circuit configured to illuminate a light when a voltage available from the battery is less than a predetermined amount, the battery compartment comprising a cover configured to be selectively removed to replace the battery.

2. The system of claim 1, the connector portion comprising inside threads, the battery compartment comprising outside threads configured to be threaded into the inside threads of the connector portion to thereby couple the battery compartment to the connector portion.

3. The system of claim 1, the connector portion comprising pegs, the battery compartment comprising slots configured to receive the pegs, the battery compartment configured to be rotated with the pegs received inside the slots to thereby couple the battery compartment to the connector portion.

4. The system of claim 1, the battery compartment comprising a pin and a conductive ring, the connector portion comprising a first contact configured to receive and form an electrical connection with the pin, the connector portion comprising a different second contact configured to form an electrical connection with the conductive ring.

5. The system of claim 1, wherein the gripping tool is a pole.

* * * * *